US011130330B2

(12) United States Patent
Leader, Jr. et al.

(10) Patent No.: US 11,130,330 B2
(45) Date of Patent: Sep. 28, 2021

(54) MULTIPLE PRINTING PLATE MOUNTING SYSTEM

(71) Applicant: LEADER ENGINEERING-FABRICATION, INC., Napoleon, OH (US)

(72) Inventors: Charles B. Leader, Jr., Napoleon, OH (US); James R. Eddy, Toledo, OH (US); James P. Lammers, Leipsic, OH (US)

(73) Assignee: LEADER ENGINEERING-FABRICATION, INC., Napoleon, OH (US)

( * ) Notice: Subject to any disclaimer, the term of this patent is extended or adjusted under 35 U.S.C. 154(b) by 272 days.

(21) Appl. No.: 16/403,022

(22) Filed: May 3, 2019

(65) Prior Publication Data

US 2019/0337289 A1 Nov. 7, 2019

Related U.S. Application Data

(60) Provisional application No. 62/668,169, filed on May 7, 2018.

(51) Int. Cl.

| | |
|---|---|
| ***B41F 27/00*** | (2006.01) |
| ***B41F 27/12*** | (2006.01) |
| ***B41F 33/00*** | (2006.01) |
| ***B41F 27/14*** | (2006.01) |

(52) U.S. Cl.

CPC ..... *B41F 27/1293* (2013.01); *B41F 27/005* (2013.01); *B41F 27/12* (2013.01); *B41F 27/1206* (2013.01); *B41F 27/14* (2013.01); *B41F 33/0081* (2013.01); *B41P 2227/11* (2013.01); *B41P 2227/20* (2013.01)

(58) Field of Classification Search

CPC .... B41F 27/005; B41F 27/14; B41F 27/1206; B41F 27/12; B41F 33/0081; B41P 2227/11; B41P 2227/20

USPC ..... 101/477

See application file for complete search history.

(56) References Cited

U.S. PATENT DOCUMENTS

| | | | | |
|---|---|---|---|---|
| 3,389,477 | A | 6/1968 | De Maria et al. | |
| 4,823,693 | A * | 4/1989 | Kobler | B41F 13/20 101/218 |
| 5,454,247 | A | 10/1995 | Powers et al. | |
| 5,887,523 | A | 3/1999 | Leader, Jr. et al. | |
| 6,270,074 | B1 | 8/2001 | Rasmussen et al. | |
| 9,266,320 | B2 | 2/2016 | Leader, Jr. et al. | |

(Continued)

*Primary Examiner* — Leslie J Evanisko

(74) *Attorney, Agent, or Firm* — Jacob M. Ward; Ward Law Office LLC

(57) ABSTRACT

The multiple printing plate mounting system of the present disclosure may be used to mount multiple flexible printing plates simultaneously onto a printing sleeve. The system has a back rotary vacuum plate with a plurality of distinct vacuum zones and may be controlled via valve by a computer control system. A filler plate may also be controlled with the same vacuum patterns. The filler plate will move minutely side-to-side. A front plate with match-controlled vacuum patterns may also have a servo to control front-to-back-movement. The distinct vacuum zones are used together with the movable front, back, and filler vacuum plates to selectively, individually, and independently align the flexible printing plates prior to mounting.

7 Claims, 12 Drawing Sheets

(56) References Cited

U.S. PATENT DOCUMENTS

| | | | | |
|---|---|---|---|---|
| 2008/0295722 | A1* | 12/2008 | Andrew ..... | B65H 9/103<br>101/477 |
| 2009/0028613 | A1 | 1/2009 | Plasswich et al. | |
| 2010/0101440 | A1 | 4/2010 | Funk et al. | |
| 2010/0307361 | A1 | 12/2010 | Leloup et al. | |
| 2016/0185103 | A1 | 6/2016 | Leader, Jr. et al. | |

* cited by examiner

MULTIPLE PRINTING PLATE MOUNTING SYSTEM

CROSS-REFERENCE TO RELATED APPLICATIONS

This application claims the benefit of U.S. Provisional Application No. 62/668,169, filed on May 7, 2018. The entire disclosure of the above application is hereby incorporated herein by reference.

FIELD

The present disclosure relates to a method and apparatus for mounting a printing plate and, more particularly, to a method and apparatus for mounting multiple flexible printing plates onto a flexographic sleeve for printing.

BACKGROUND

Modern printing techniques require a high degree of accuracy in the mounting and alignment of flexible printing plates on flexographic printing sleeves. The image must be straight and in register on the sleeve in order to print correctly, and to be in register on the final work.

One known solution to mounting and aligning a printing plate is described in U.S. Pat. No. 9,266,320 to Leader, Jr. et al., the entire disclosure of which is hereby incorporated herein by reference. This patent describes a method and apparatus for mounting a printing plate onto a printing mandrel, wherein the printing plate includes a first registration mark and a second registration mark centrally located along opposing edges thereof. The apparatus includes an optical system to transmit images of the registration marks to a user interface. A user selects a desired location point location of each of the registration marks displayed on the user interface to facilitate an alignment of the printing plate in respect of a central axis of the printing mandrel.

These traditional mounting systems, however, have involved mounting of multiple printing plates onto the printing sleeve one at a time. Thus, while these known mounting systems have been revolutionary and have improved alignment of the flexible plates on the printing sleeves immensely, they also have been limited in efficiency.

There is a continuing need for a system and method for mounting multiple printing plates more efficiently. Desirably, the system and method will permit the alignment and simultaneous application of the multiple printing plates to a single printing sleeve.

SUMMARY

In concordance with the instant disclosure, a system and method for mounting multiple printing plates more efficiently, and which will permit the alignment and simultaneous application of the multiple printing plates to a single printing sleeve, is surprisingly discovered.

In one embodiment, a multiple printing plate mounting system includes a base, a front table, a back table, a filler table, and a control system. The base has a mandrel for supporting a printing sleeve, which is configured to receive a plurality of flexible printing plates thereon. The plurality of flexible printing plates includes a first printing plate and a second printing plate. The mandrel has a central axis about which the mandrel may be rotated. The front table is movably coupled to the base and has a plurality of vacuum zones. The back table is movably coupled to the base and has a plurality of vacuum zones. The filler table is movably coupled to the base and has a plurality of vacuum zones. The filler table is selectively disposed between the front table and the back table in order to provide support to the plurality flexible printing plates during the alignment thereof. The plurality of vacuum zones includes a first vacuum zone and a second vacuum zone. The control system is in communication with the front table, the back table, and the filler table. The control system is configured to cause a movement of at least one of the front table, the back table, and the filler table for selective, individual, and independent alignment of each of the plurality of flexible printing plates relative to the central axis of the mandrel.

In another embodiment, the multiple printing plate mounting system further includes a cylinder transfer assembly. The cylinder transfer assembly is disposed adjacent to, but normally spaced apart from, the base of the system. The cylinder transfer assembly includes a support, a tower, and a sleeve tube. The tower is disposed on the support and laterally movable relative to the support. The sleeve tube is disposed on the tower and rotatably movable about a longitudinal axis of the tower between a loading position and a mounting position. The cylinder transfer assembly is configured to selectively mount the printing sleeve onto the mandrel of the support.

In a further embodiment, a method for mounting multiple printing plates includes steps of mounting the printing sleeve on the mandrel and disposing the first printing plate in the first vacuum zone, and the second printing plate in the second vacuum zone, across all of the front table, the filler table, and the back table. The control system then applies vacuum suction in the first vacuum zone, and at least one of the front table, the filler table, and the back table is moved with the vacuum suction applied in the first vacuum zone to align the first printing plate. The control system then unapplies the vacuum suction in the first vacuum zone and applies the vacuum suction in the second vacuum zone. Then at least one of the front table, the filler table, and the back table is moved with the vacuum suction applied in the second vacuum zone to align the second printing plate. The method then includes the step of mounting the plurality of printing plates including the first printing plate and the second printing plate simultaneously, upon being aligned, onto the printing sleeve.

In yet another embodiment, the method further includes a step of providing the sleeve tube of the cylinder transfer assembly in the loading position. The sleeve tube is not in axial alignment with the mandrel in the loading position. The printing sleeve is then loaded onto the sleeve tube of the cylinder transfer assembly. The sleeve tube of the cylinder transfer assembly is then rotated to the mounting position. The sleeve tube is in axial alignment with the mandrel in the mounting position. The sleeve tube is then engaged with the mandrel by moving the tower on the support toward the base. The printing sleeve is then slid from the sleeve tube and onto the mandrel. The sleeve tube is then disengaged from the mandrel by moving the tower on the support away from the base. The printing sleeve is thereby mounted onto the mandrel for use in the method for mounting multiple printing plates.

In an exemplary embodiment, the system of the present disclosure may be used to simultaneously mount up to six (6) printing plates, although other numbers of plates may also be mounted simultaneously within the scope of the present disclosure. The system has a back rotary vacuum plate with twelve (12) areas of vacuum, and may be controlled via a valve by a computer. A filler plate may also be controlled with the same vacuum patterns. The filler plate will move minutely side-to-side. A front plate with match-controlled vacuum patterns may also have a servo to control front-to-back-movement.

In operation, the method of the present disclosure may include the following steps in sequence. The operator will place the six (6) printing plates with the assistance of a pointing laser on the left register point of each plate and a double line on the right register point. This is done to position all plates so the cameras will be able to easily find them in the auto mode. The operator starts the automatic process. The wide-view camera comes over the left register point and the system finds the first left register point. The magnifying camera locates the register point and stores its position. The camera moves to the right register point and locates its exact position. With the vacuum on, the back plate is rotated to remove all skew in the first printing plate. With the data that was observed between register points, the center of the plate left to right is determined. The filler plate is moved to place the plate at its designed position. The vacuum is turned on at the front table. The front table is moved to pull the first printing plate ahead so that the first printing plate is over dead center of the mandrel. The vacuum is turned on at the filler plate to hold the first printing plate in the designed position. These series of steps are repeated for the second through the sixth printing plates to position all of the printing plates in a designed position with zero skew and designed position between all plates 1 to 2, 2 to 3, 3 to 4 and 5 to 6.

With vacuum still on at the filler plate, with the rotary table at zero (0) position and the front table at zero (0) position, the table's vacuum is turned on both rotary and front tables. The filler plate vacuum is turned off and removed so that the mandrel can be raised to kiss the bottom of the plates. The pressure roll is placed over all plates applying all plates to the stickyback. The pressure roll is interpolated around the 180 degrees of the front part of the mandrel. The pressure roll is brought forward, up and back over the mandrel to a position and the mandrel rotated to apply the remaining portion of the printing plates after turning off the vacuum of the back table. The mandrel will position the register point on top dead center of the mandrel. The camera will check all register points to determine if all are correctly positioned to specifications. The method of mounting the printing plates according to the present method is thereby completed.

In another particular embodiment, the system is configured to produce high accuracy data that can be transferred to the press to inform them that the mounts will produce a finished product that customers require. After every move of the system, the move is checked to confirm that the move is correct within the specification that has been preset. This is then checked color-to-color to again confirm that all plates are correctly mounted to produce an optimum result that can be made with the plates provided. Deviation between plates is determined and divided in two, so half the deviation is on the right and left position of the plate centerline.

Speed to mount up to six (6) plates should be within five (5) minutes. This includes one (1) minute for the placement of all plates by the operator with the assistance on laser point so the plate can be found by the cameras. After this, the vision system will automatically remove skew, move the plate to top dead center, and move the filler table so the printing plate center is positioned correctly, and the vacuum turned on holding the plate position while the remaining plates are brought to their positions.

With all plates in position and verified, a pressure roller will be positioned at top dead center by turning on the vacuum on the front and back tables, and removing vacuum on the filler table, raising the sleeve to kiss the bottom of the printing plates, and removing the vacuum on the front table. The front one hundred and eighty degrees (180°) of the printing plate is then applied by interpolating the pressure roller around the front part of the sleeve. The pressure roller is then brought back to top dead center, the vacuum is turned off on the back table, and the sleeve is rotated to apply the remaining portion of the plates to the sleeve. This method removes the need for the operator to apply the plate, minimizing an opportunity for carpel tunnel in the operator, and also minimizing the process time by three (3) minutes. Data from the system may then be fed to a press in order to place the sleeve into the press. The accuracy of the system should be in the range of about 75 microns.

In an illustrative embodiment, an operation sequence for the system includes the operator manually placing a correct number of plates on the filler table by placing to a left register point under the laser pointer and the right between the scribe line. This manual placement is repeated until all plates that are required are on the table. The operator then removes self from the vicinity of the system, and the system is automatically run via the control system.

The system will then go to the left register point on the left most printing plate to determine its location via wide-view and close-up view cameras. This is also performed on the right register point. The data is fed to the computer control system to calculate the plate's position and compare it to a theoretical position. The plate is then positioned to the theoretical position by a vacuum system on all of the front, back, and filler tables. Each table may have twelve (12) patterns, which are controlled on and off as required by the computer control system placing the plate on hold in its designated position. This sequence of steps is completed for all plates.

The vacuum is then turned on the front and back tables and off on the filler table. The filler table is then removed, and the sleeve is brought up to kiss the bottom of the printing plates. The pressure roller is moved to apply pressure to the plates, thereby applying the plates to the sleeve. The pressure roller is then interpolated around the sleeve for one hundred and eighty degrees (180°), thereby applying the front portion of the plates to the sleeve. The pressure roller is then moved to top dead center and the sleeve is rotated to apply the back one hundred and eighty degrees (180°), thereby mounting the rest of the plates.

At this stage of the method, all register points are checked and stored in the control system for skew and alignment on each sleeve. All sleeves are checked to ensure that all sleeves are matching all other sleeves on the same job. At any point, the data deviation can be established and set so that the machine can inform the operator that there is an issue requiring intervention. This information can also be sent to other required points in the process.

DRAWINGS

The above, as well as other advantages of the present disclosure, will become readily apparent to those skilled in the art from the following detailed description, particularly when considered in the light of the drawings described hereafter.

Figure 1:
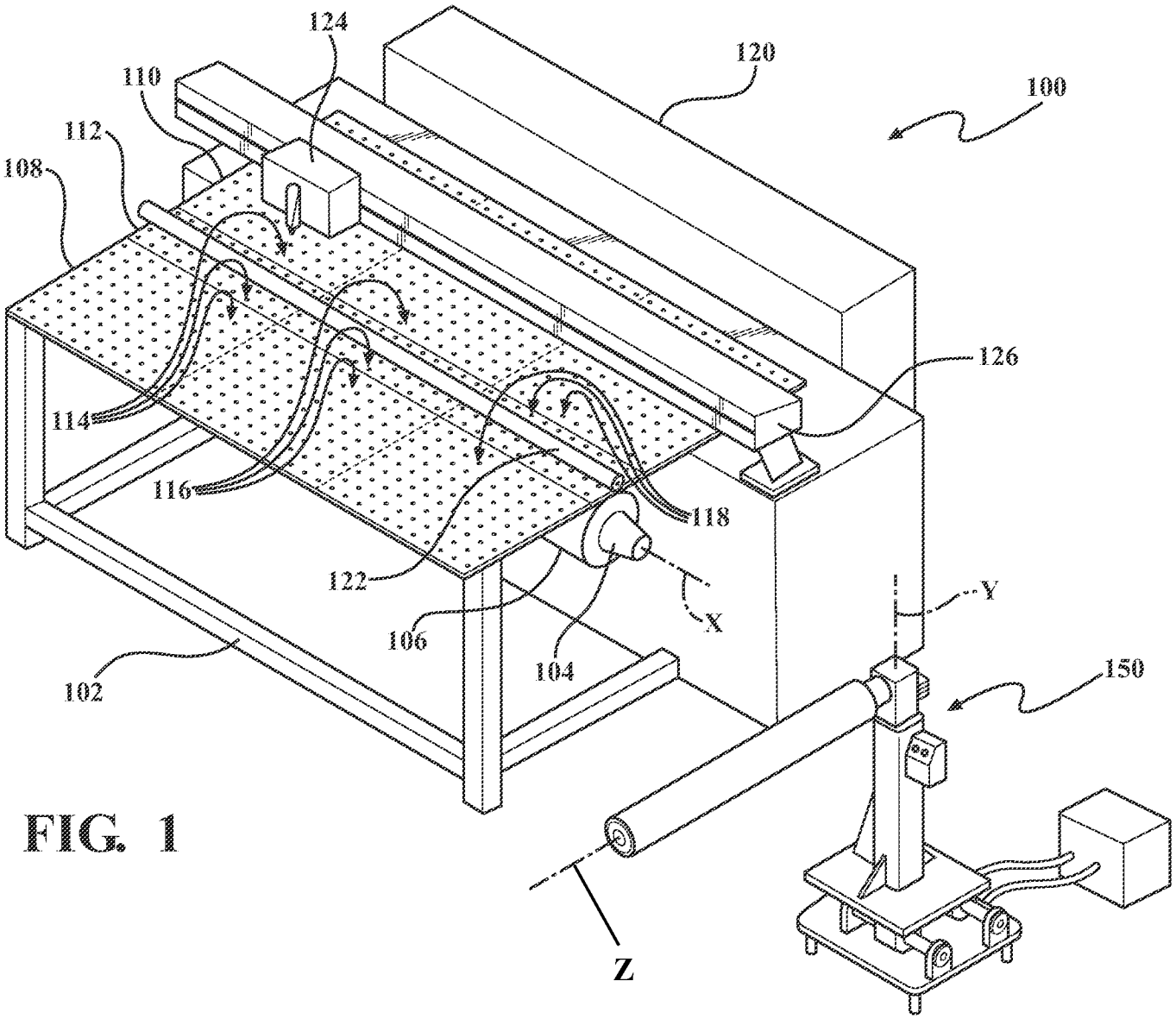
FIG. 1 is a top perspective view of a multiple printing plate mounting system according to one embodiment of the present disclosure, the printing plate mounting system having a back plate, a filler plate, a front plate, a roller, and a mandrel having a sleeve installed thereon, and further showing a cylinder transfer assembly disposed adjacent the printing plate mounting system.
Figure 2:
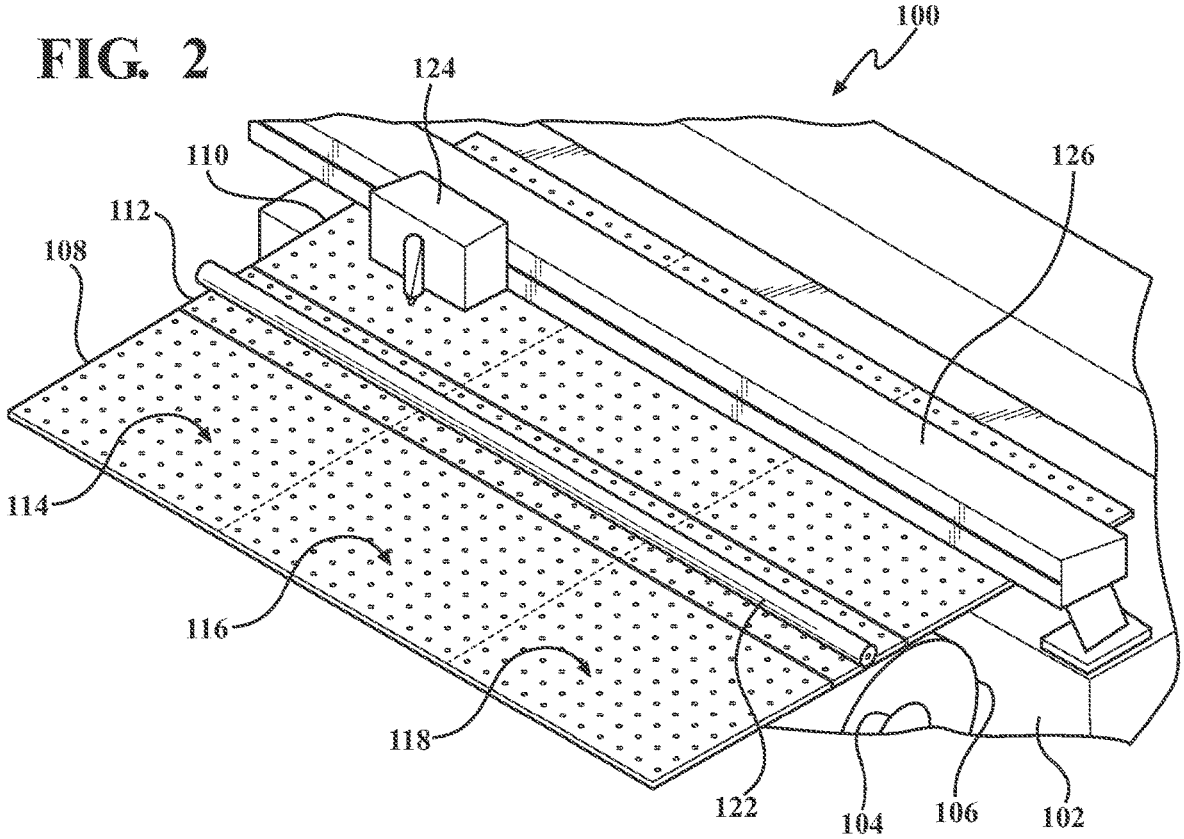
FIG. 2 is an enlarged, fragmentary, top perspective view of the multiple printing plate mounting system shown in FIG. 1, and further showing a front table and a rear table for receiving a plurality of printing plates.
Figure 23:
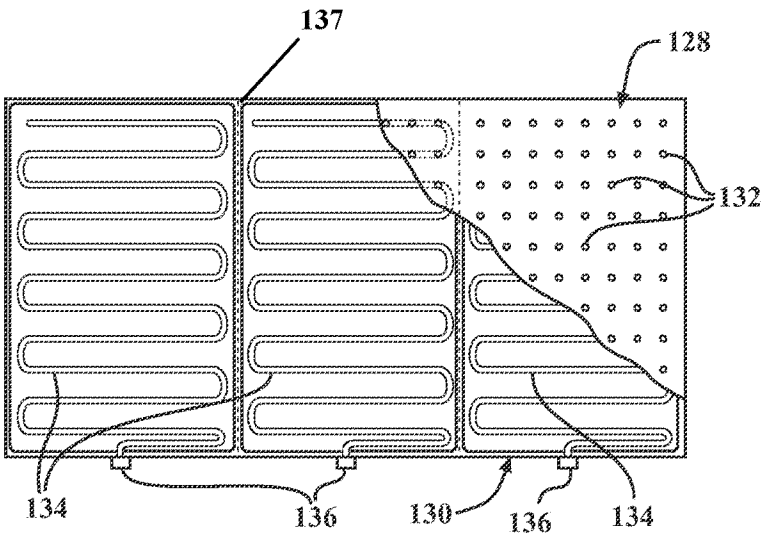
Figure 22:
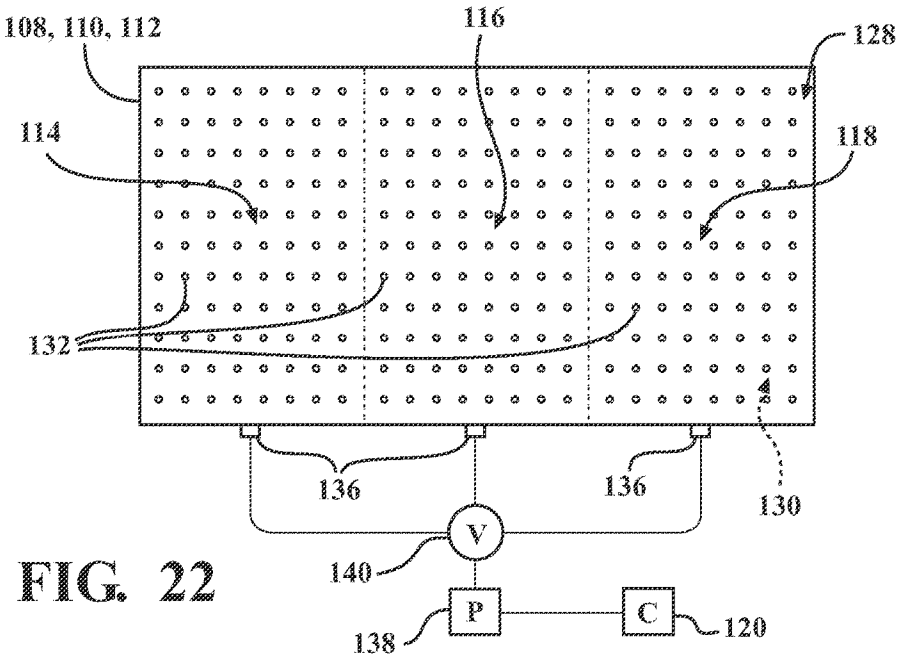

FIG. 22 is a top plan view of one of the front table, the filler table, and the back table of the multiple printing plate mounting system shown in FIG. 1, the table having a plurality of discrete vacuum zones that may be separately actuated for individual and selective positioning of the plates; and FIG. 23 is a fragmentary, top plan view of the one of the front table, the filler table, and the back table shown in FIG. 22, and illustrating a top portion of the table partly removed in order to depict the underlying seals and channels defining the discrete vacuum zones.

DETAILED DESCRIPTION

The present description is merely exemplary in nature and is not intended to limit the present disclosure, application, or uses. In respect of the methods disclosed, the order of the steps presented is exemplary in nature, and thus, is not necessary or critical unless otherwise disclosed.

Figure 3:
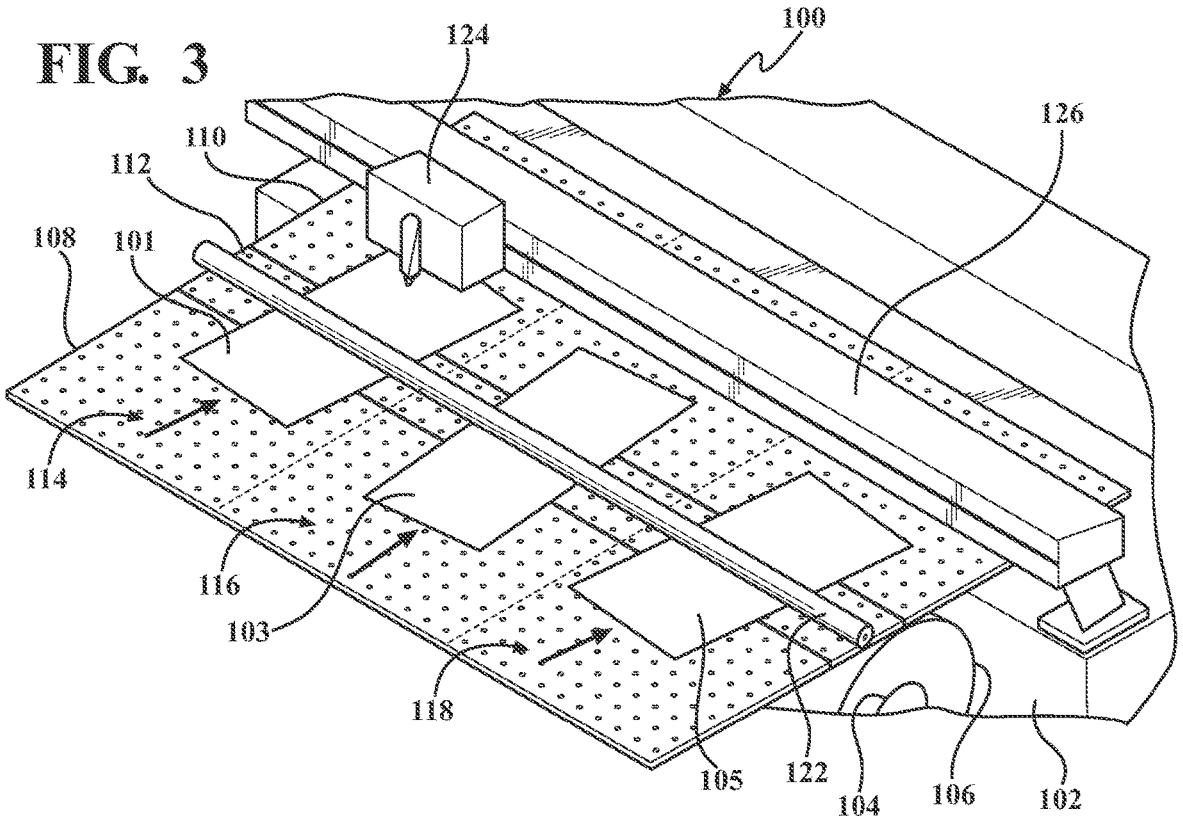
FIG. 3 is an enlarged, fragmentary, top perspective view of the multiple printing plate mounting system shown in FIG. 1, and further showing the plurality of printing plates disposed on the front table and the rear table of the printing plate mounting system with manual alignment only.

As shown in FIG. 1-23, the present disclosure includes a multiple printing plate mounting system 100. The system 100 has a base 102 with a mandrel 104 for supporting a printing sleeve 106. The base 102 generally rests upon, or is attached to, a floor surface. The mandrel 104 has a central axis X about which the mandrel 104 may be rotated. The printing sleeve 106 is configured to receive a plurality of flexible printing plates 101, 103, 105, for example, as shown in FIG. 3.

Throughout the present disclosure, and particularly in FIGS. 3-9, the plurality of flexible printing plates 101, 103, 105 are shown as including a first printing plate 101, a second printing plate 103, and a third printing plate 105.

However, it should be appreciated that one of ordinary skill in the art may employ only two printing plates 101, 103, or may employ more than three printing plates 101, 103, 105, for use with the system 100 and method of the present disclosure, as desired. In a most particular embodiment, the plurality of printing plates 101, 103, 105 may include up to six (6) or more printing plates 101, 103, 105.

As shown in FIG. 1, the base 102 further supports a front table 108, a back table 110, and a filler table 112. The filler table 112 is selectively and removably disposed between the front table 108 and the back table 110 in order to provide support to the plurality flexible printing plates 101, 103, 105 during the alignment thereof. Each of the front table 108, the back table 110, and the filler table 112 is movably coupled to the base 102. Each of the front table 108, the back table 110, and the filler table 112 also has a plurality of vacuum zones 114, 116, 118, respectively.

For purposes of illustration, the plurality of vacuum zones 114, 116, 118 are shown in the present disclosure as including a first vacuum zone 114, a second vacuum zone 116, and a third vacuum zone 118. However, as with the plurality of flexible printing plates 101, 103, 105 described herein, it should be appreciated that one of ordinary skill in the art may employ only two vacuum zones 114, 116, or more than three vacuum zones 114, 116, 118, for use with the system 100 and method of the present disclosure. In a most particular embodiment, the plurality of vacuum zones 114, 116, 118 may include up to twelve (12) or more vacuum zones 114, 116, 118.

The system 100 of the present disclosure further includes a control system 120. The control system 120 is in communication with the front table 108, the back table 110, and the filler table 112. For example, the control system 120 may be in communication with one or more actuators or servo motors (not shown) that are connected to at least one of the front table 108, the back table 110, and the filler table 112 and configured to move or rotate the same within the scope of the disclosure. Such actuators or servo motors for movement of the front table 108, the back table 110, and the filler table 112 are described in U.S. Pat. No. 9,266,320 to Leader, Jr. et al., the entire disclosure of which is hereby incorporated herein by reference.

In a particular example, the control system 120 includes a programmable controller (not shown) connected to control all of the actuators, cameras, laser pointers, etc. of the system 100. Thus, the control system 120 generates control signals to control movement of the tables 108, 110, 112, the pressure roller 122, the instrument carriage 124, and the mandrel 104 having the pressure sleeve 106. The control system 120 may further include a user interface (not shown) such as a touch screen, for example, in electrical communication with the control system 120. The user interface permits the operator to enter inputs such as a location of registration marks of the printing plates 101, 103, 105, zoom commands, sizes of the printing sleeve 106, and the like, for example. It is understood that the user can enter the input using any input device as desired such as by a touch panel, a keyboard, a mouse, a joystick, or the like, as non-limiting examples.

The control system 120 is configured to cause a movement of at least one of the front table 108, the back table 110, and the filler table 112 for selective, individual, and independent alignment of each of the plurality of flexible printing plates 101, 103, 105 relative to the central axis X of the mandrel 104. In particular, the front table 108 may be configured to move front-to-back relative to the mandrel 104. The back table 110 may be configured to rotate or interpolate relative to the mandrel 104. The filler table 112 may be configured to move side-to-side relative to the mandrel 104. The filler table 112 may also be configured to be removed entirely from between the front table 108 and the back table 110, for example, during the method for mounting the plates 101, 103, 105 to the printing sleeve 106 as described further herein. A skilled artisan may select other suitable movements for each of the front table 108, the back table 110, and the filler table 112 consistent with the methods of the present disclosure, as desired.

With reference to FIGS. 1-3, 6-17, and 21, the system 100 of the present disclosure further includes a pressure roller 122. The pressure roller 112 is movably coupled to the base 102, for example, with one of the actuators or servo motors (not shown). The pressure roller 112 is configured to selectively interpolate about the printing sleeve 106 to simultaneously secure all of the plurality of flexible printing plates 101, 103, 105 to the printing sleeve 106 in accordance with the methods of the present disclosure, described further herein.

Figure 4:
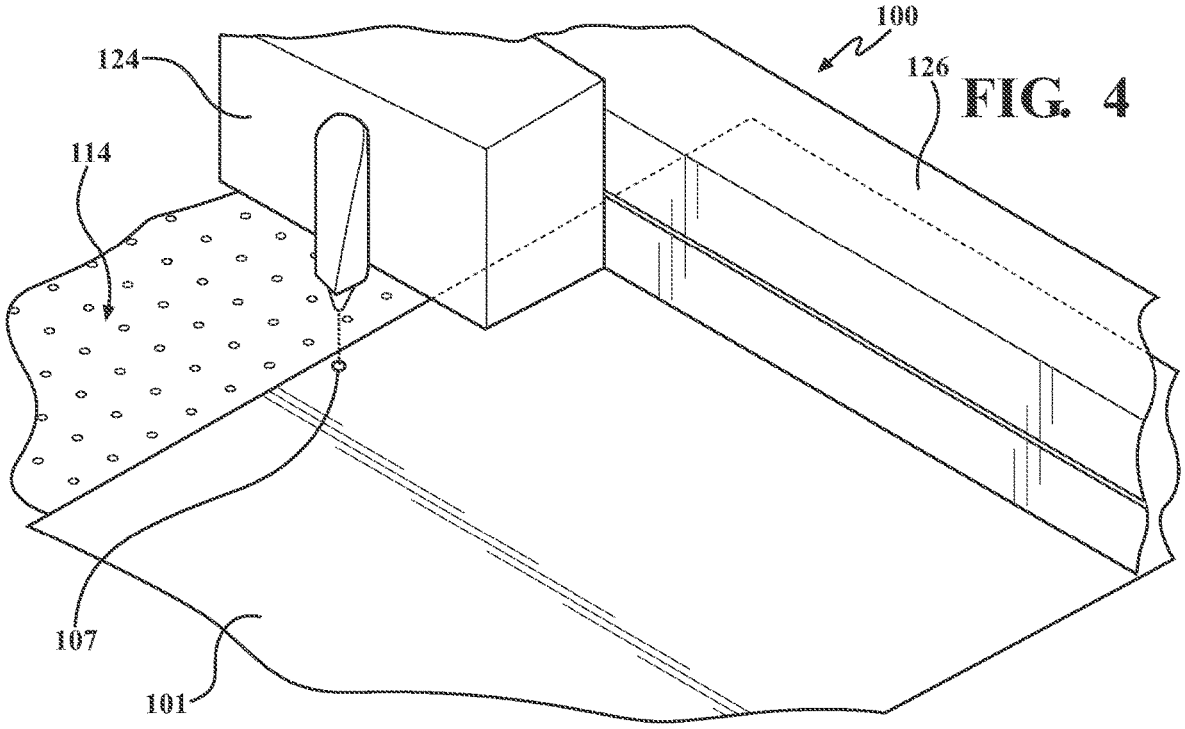
FIG. 4 is an enlarged, fragmentary, top perspective view of the multiple printing plate mounting system shown in FIG. 1, and illustrating use of a camera and laser at a first position for interaction with a first register mark to facilitate alignment of each of the printing plates.
Figure 5:
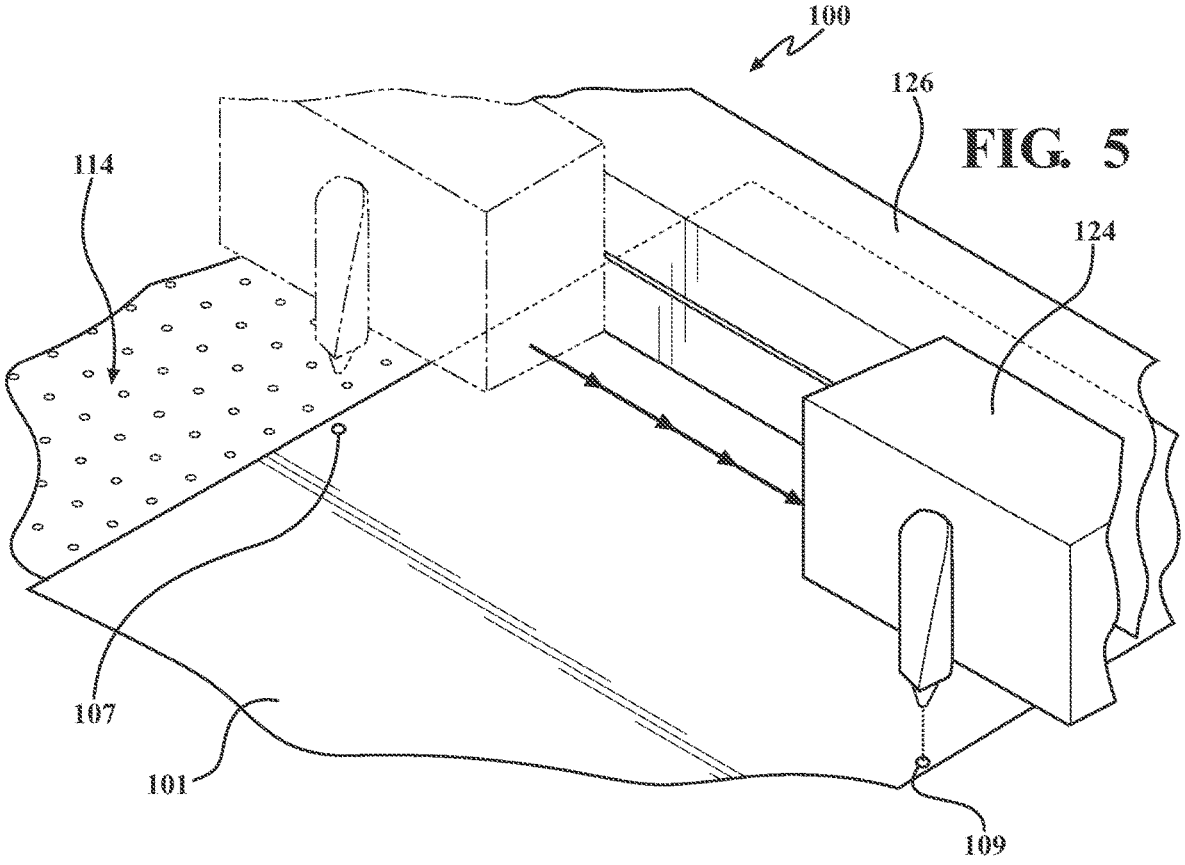
FIG. 5 is an enlarged, fragmentary, top perspective view of the multiple printing plate mounting system shown in FIG. 1, and illustrating a movement of the camera and laser to a second position for interaction with a second register mark to facilitate the alignment of each of the printing plates.
Figure 6:
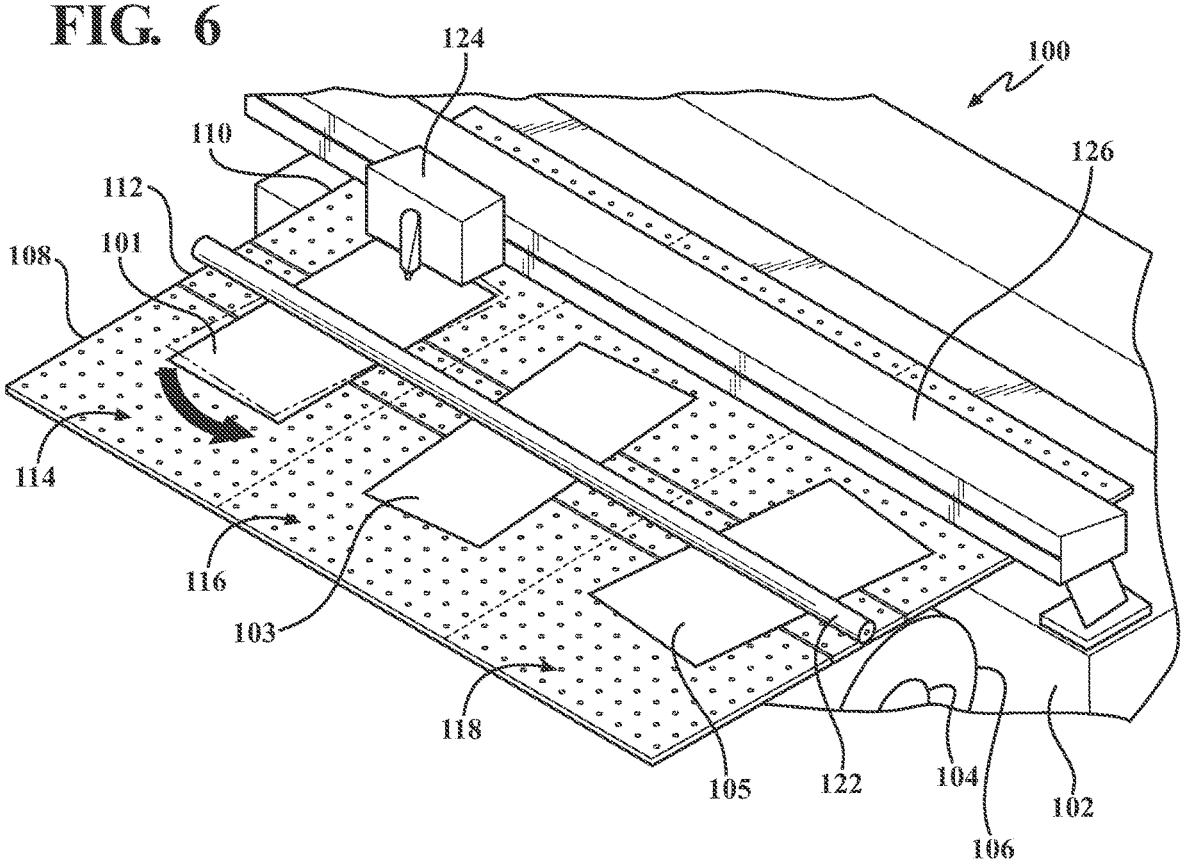
FIG. 6 is an enlarged, fragmentary, top perspective view of the multiple printing plate mounting system shown in FIG. 1, and illustrating a rotational movement of a single one of the printing plates, without movement of the other printing plates, for purposes of the alignment.
Figure 7:
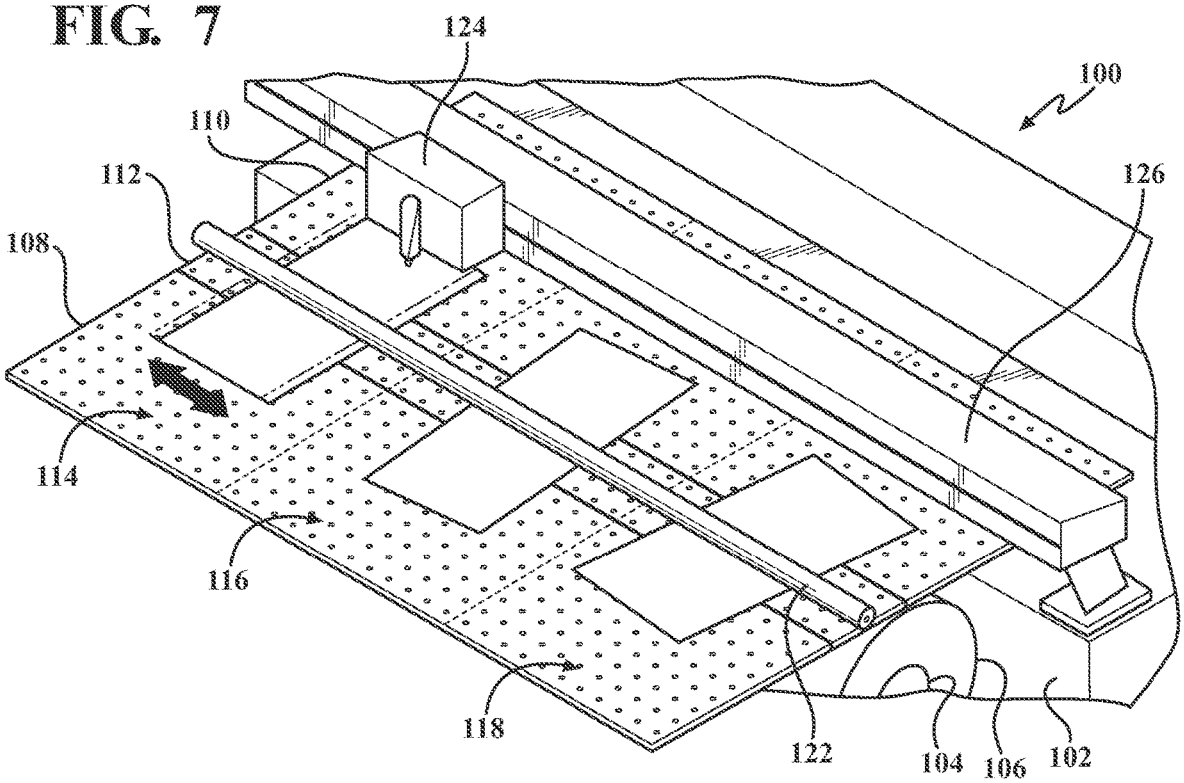
FIG. 7 is an enlarged, fragmentary, top perspective view of the multiple printing plate mounting system shown in FIG. 1, and illustrating a lateral movement of a single one of the printing plates, without movement of the other printing plates, for purposes of the alignment.
Figure 8:
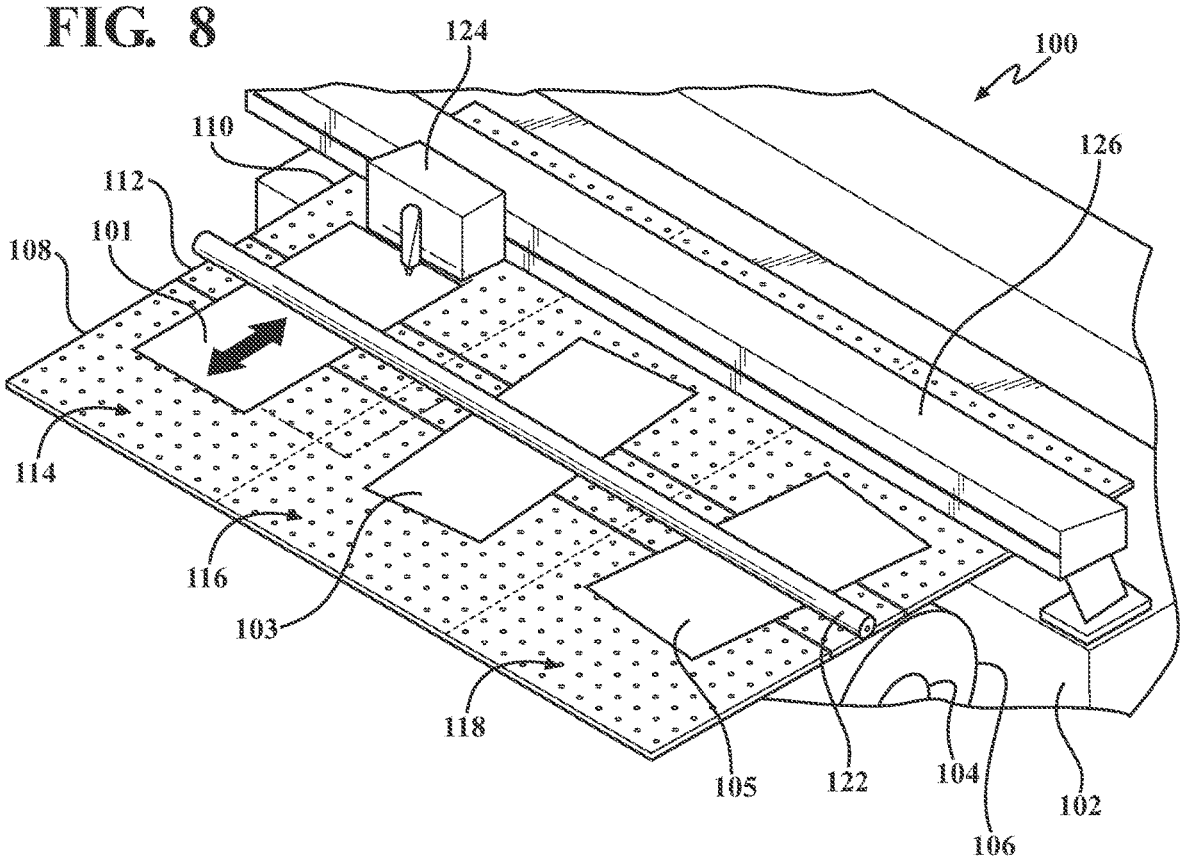
FIG. 8 is an enlarged, fragmentary, top perspective view of the multiple printing plate mounting system shown in FIG. 1, and illustrating a longitudinal movement of a single one of the printing plates, without movement of the other printing plates, for purposes of the alignment.
Figure 9:
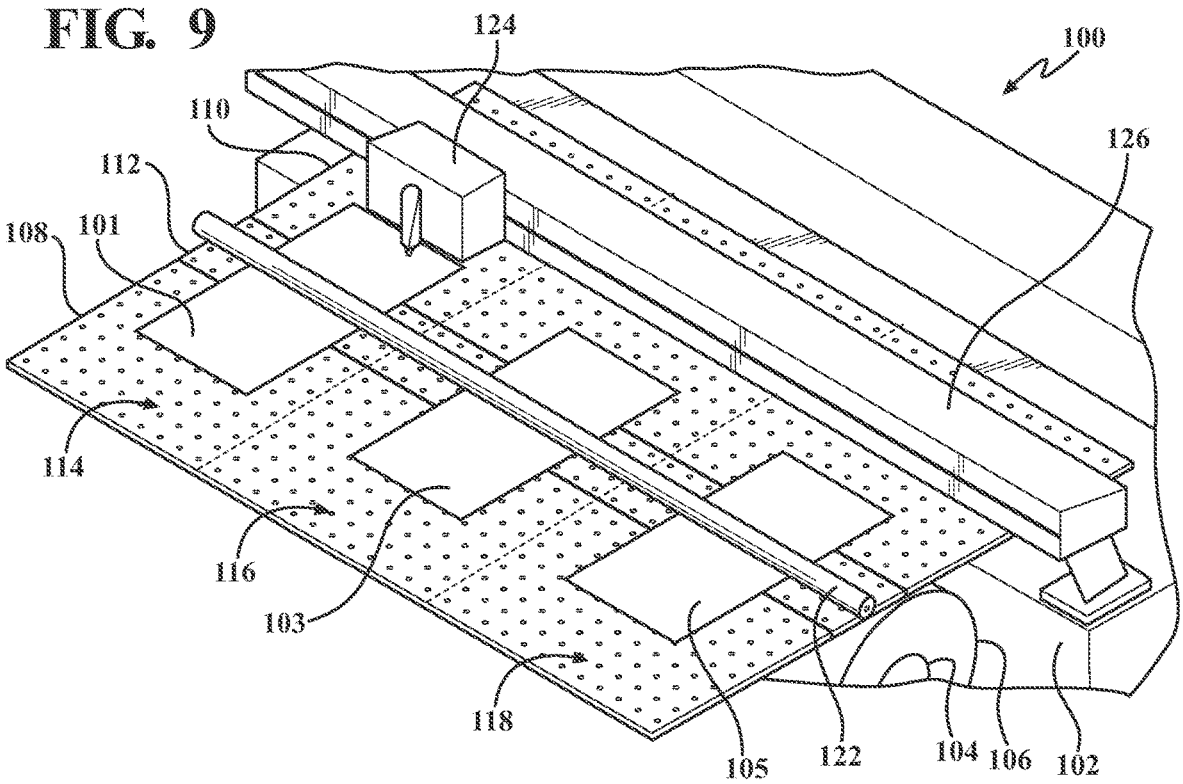
FIG. 9 is an enlarged, fragmentary, top perspective view of the multiple printing plate mounting system shown in FIG. 1, and illustrating each of the printing plates in aligned positions following the individual movements of each of the printing plates as shown in FIGS. 6-8.

Referring now to FIGS. 4-5, the system 100 may also include an instrument carriage 124 that is movably coupled to the base 102. For example, the instrument carriage 124 may be laterally movable on a bridge member 126 that is attached to the base 102 and disposed at an elevated position relative to the tables 108, 110, 112. The bridge member 126 may include tracks or rails to which the instrument carriage 124 may be laterally, movably attached, for example. Other suitable means for movably disposing the instrument carriage 124 on the base 102 may also selected by a skilled artisan, as desired.

The instrument carriage 124 may include an optical system, such as one or more cameras, and a laser pointer, each in communication with the control system 120. The optical system may be employed by the control system 120 to visualize the various flexible printing plates 101, 103, 105 when disposed on the tables 108, 110, 112. The laser pointer is configured to project a laser light for manual orientation of the flexible printing plates 101, 103, 105 by an operator, for example, as shown in FIGS. 4-5, by aligning the laser light with registration marks 107, 109 and scribe lines that may be formed on the flexible printing plates 101, 103, 105. For example, the laser pointer may be laterally movable on the track of the bridge member 126 about the tables 108, 110, 112 in order to project the laser light at multiple predetermined locations associated with proper registration or positioning of the printing plates 101, 103, 105. In this manner, the operator may roughly pre-align the printing plates 101, 103, 105 prior to a fine alignment by the system 100 in accordance with the present disclosure.

With reference to FIGS. 22-23, each of the front table 108, the back table 110, and the filler table 112 may be configured to selectively and individually provide vacuum suction at each of the vacuum zones 114, 116, 118. For example, each of the front table 108, the back table 110, and the filler table 112 may have an upper portion 128 and a lower portion 130. The upper portion 128 may have a plurality of vacuum holes 132 formed therethrough, through which the vacuum suction is applied to the flexible printing plates 101, 103, 105 in operation. Furthermore, as shown in FIG. 23, a plurality of flow channels 134 may be formed between the upper portion 128 and the lower portion 130. The flow channels 134 are in fluid communication with select ones of the vacuum holes 132.

In particular, it should be understood that each of the vacuum zones 114, 116, 118 is discrete and separate from the other vacuum zones 114, 116, 118. This permits each of the vacuum zones 114, 116, 118 to be individually operated, such that only one zone 114, 116, 118 of the table 108, 110, 112 may have the vacuum suction applied at any given time. Likewise, it should be appreciated that within each zone 114, 116, 118, each of the tables 108, 110, 112 may have the vacuum suction applied or unapplied, in order to interact with just sections of the flexible printing plates 101, 103, 105 in accordance with the methods disclosed herein.

In order to provide the discrete separation of the vacuum zones 114, 116, 118, each of the tables 108, 110, 112 may further include a gasket seal 137, for example, as shown in FIG. 23. The gasket seal 137 is disposed between the upper portion 128 and the lower portion 130. The gasket seal 137 may be polymeric, for example, and the upper and lower portions 128, 130 may be metal plates that sandwich the gasket seal 137 therebetween. The gasket seal 137 separates individual ones of the vacuum zones 114, 116, 118.

In particular embodiments, the gasket seal 137 may ensure that a first set of the flow channels 134, which may be associated with the first zone 114, is not in communication with a second set of the flow channels 134, which may be associated with the second zone 116. This configuration permits the vacuum suction to be selectively applied to one of the vacuum zones 114, 116, 118 while it is not being applied to another of the vacuum zones 114, 116, 118.

For example, where the plurality of vacuum zones 114, 116, 118 includes the first vacuum zone 114, the second vacuum zone 116, and the third vacuum zone, the plurality of flow channels 134 may include a first flow channel, a second flow channel, and a third flow channel, In this case, the first flow channel is disposed in the first vacuum zone 114, the second flow channel is disposed in the second vacuum zone 116, and the third flow channel is disposed in the third vacuum zone 118.

Each of the flow channels 134 may also be in communication with its own port 136, as shown in FIGS. 22-23, which is in communication with a vacuum pump 138 via a valve 140. Each of the port 136 may be formed in an associated one of the front table 108, the back table 110, and the filler table 112, for example. The vacuum pump 138 and the valve 140 may further be in communication with the control system 120, which is configured to both operate the vacuum pump 138 and to select a position of the valve 140 so that the same vacuum pump 138 may be used to provide the vacuum suction selectively at each of the vacuum zones 114, 116, 118.

Although the flow channels 134 and the gasket seal 137 between the first and second portions 128, 130 of the table 108, 110, 112, and a single vacuum pump 138 and valve 140 are shown and described herein as one particular means for providing the selective and individual vacuum suction to the different vacuum zones 114, 116, 118, other suitable means for providing the discrete vacuum zones 14, 116, 118, including additional pumps, valves, and ports, are contemplated and considered to be within the scope of the present disclosure.

With renewed reference to FIGS. 1 and 15-21, the multiple printing plate mounting system 100 of the present disclosure may further include a cylinder transfer assembly 150. The cylinder transfer assembly 150 is configured to selectively mount the printing sleeve 106 onto the mandrel 104 of the support 102. For this purpose, the cylinder transfer assembly 150 may be disposed adjacent to the base 102 of the system 100. The cylinder transfer assembly 150 includes a sleeve tube 152, a support 154, and a tower 156. The support 154 generally rests upon, or is attached to, the floor surface. The tower 156 is disposed on the support 154 and is laterally movable relative to the support 154. The sleeve tube 152 is disposed on the tower 156. The sleeve tube 152 is rotatably movable about a longitudinal axis Y of the tower 156 between a loading position (shown in FIGS. 1 and 16) and a mounting position (shown in FIGS. 17-21).

In certain embodiments, the support 154 of the cylinder transfer assembly 150 may have a pair of actuators 158. The actuators 158 are configured to cause the lateral movement of the sleeve tube 152 and tower 156 between a disengaged position (shown in FIG. 18) and an engaged position (shown in FIG. 18), for example. An additional actuator or actuators (not shown) may also be employed to cause the rotational movement of the sleeve tube 152 about the axis Y between the loading position and the mounting position. Each of the actuators 158 may be pneumatic, hydraulic, or electric, for example, and may be further in communication with a source 160 of pressurized air, hydraulic fluid, or an electrical power, for example.

The actuators 158 may be in further in communication with a controller 162 disposed on the tower 156, which permits the operator to selectively move either the sleeve tube 152 and the tower 158 laterally, or which permits the operator to selectively rotate the sleeve tube 152 about the axis Y. In further embodiments, the controller 162 may be part of the control system 120 of the system 100. Other suitable means including manual switches and computerized controls may also be employed as desired.

In operation, the multiple printing plate mounting system 100 of the present disclosure may be employed in a method for simultaneously mounting the plurality of printing plates 101, 103, 105 to the printing sleeve 106. The method includes a first step of mounting the printing sleeve 106 on the mandrel 104, where employed, for example, as shown in FIGS. 16-21. Where the printing sleeve 106 is not employed, the system 100 may likewise be employed to simultaneously mount the plurality of printing plates 101, 103, 105 directly to a printing cylinder (not shown).

The method the present disclosure then includes a second step of disposing the first printing plate 101 in the first vacuum zone 114, and the second printing plate 103 in the second vacuum zone 116, across all of the front table 108, the filler table 112, and the back table 110. Although the method is described herein with respect to the first and second printing plates 101, 103, and the first and second vacuum zones 114, 116, it should be understood that any number of flexible printing plates 101, 103, 105 and vacuum zones 114, 116, 118 may be employed within the scope of the present disclosure.

It should be appreciated that the disposition of the first and second printing plates 101, 103 may initially be done manually, with the operator placing the first and second printing plates 101, 103 by hand into their respective first and second vacuum zones 114, 116. To assist with this initial placement and orientation of the plates 101, 103, 105, each of the flexible printing plates 101, 103, 105 may be provided with a plurality of registration marks 107, 109 and scribe lines (not shown). The registration marks 107, 109 may include a first registration mark 107 and a second registration mark 109.

In this embodiment, the laser pointer of the instrument carriage 124 may be employed to facilitate the initial manual placement. For example, the method may include the steps of providing the laser pointer at a position adjacent to a first side of the first printing plate 101, and then projecting the laser light, by the laser pointer, toward the first printing plate 101 as shown in FIG. 5. The operator may then manually orient the first printing plate 101 so that a first registration mark 107 of the first printing plate 101 coincides with the laser light. Then, the laser pointer may be moved to a position adjacent to a second side of the first printing plate 101. The method then includes steps of projecting the laser light, by the laser pointer, toward the first printing plate 101 and the operator manually orienting the first printing plate so that the second registration mark 109 coincides with the laser light. The first printing plate 101 is thereby roughly oriented and ready for the automated alignment process as further described hereinbelow. It should also be appreciated that each of these steps may be repeated for second printing plate 103 and any subsequent printing plates 105, so that all of the plates 101, 103, 105 are readied for the remainder of the method.

The method further includes a step of applying, by the control system 120, vacuum suction in the first vacuum zone 114. The control system 120 is further used to move at least one of the front table 108, the filler table 112, and the back table 110 with the vacuum suction applied in the first vacuum zone 114 to align the first printing plate 101. It should be understood that the vacuum suction may be applied at individual ones of the tables 108, 110, 112, or combinations of the ones of the tables 108, 110, 112, as they are moved in order to align the first plate 101 appropriately.

Then, the control system 120 will unapply or remove the vacuum suction from the first vacuum zone 114, and apply the vacuum suction in the second vacuum zone 116. As with the alignment of the first plate 101, the method then includes a step of moving at least one of the front table 108, the filler table 112, and the back table 110 with the vacuum suction applied in the second vacuum zone 116 to align the second printing plate 103. These steps may further be repeated for any subsequent printing plates 105.

The method may further include steps of proofing the aligned position of each of the first plate 101 and the second plate 103 with the laser pointer or cameras of the instrument carriage 124 following the first printing plate 101 and the second printing plate 103 being aligned. It should be appreciated that this proofing step will ensure the proper alignment before the subsequent mounting operation, as described further herein.

Figure 10:
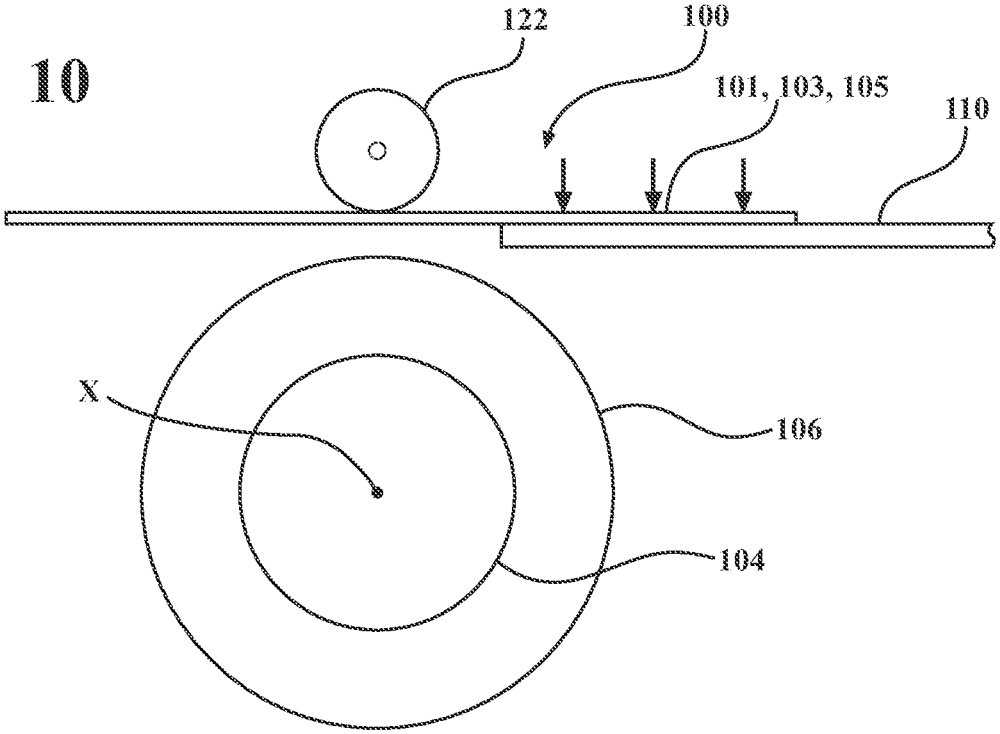
FIG. 10 is an enlarged, side elevational view of the multiple printing plate mounting system shown in FIG. 1, and illustrating the system with the filler plate having been moved so that the sleeve may be raised to contact bottoms of all of the printing plates simultaneously.
Figure 11:
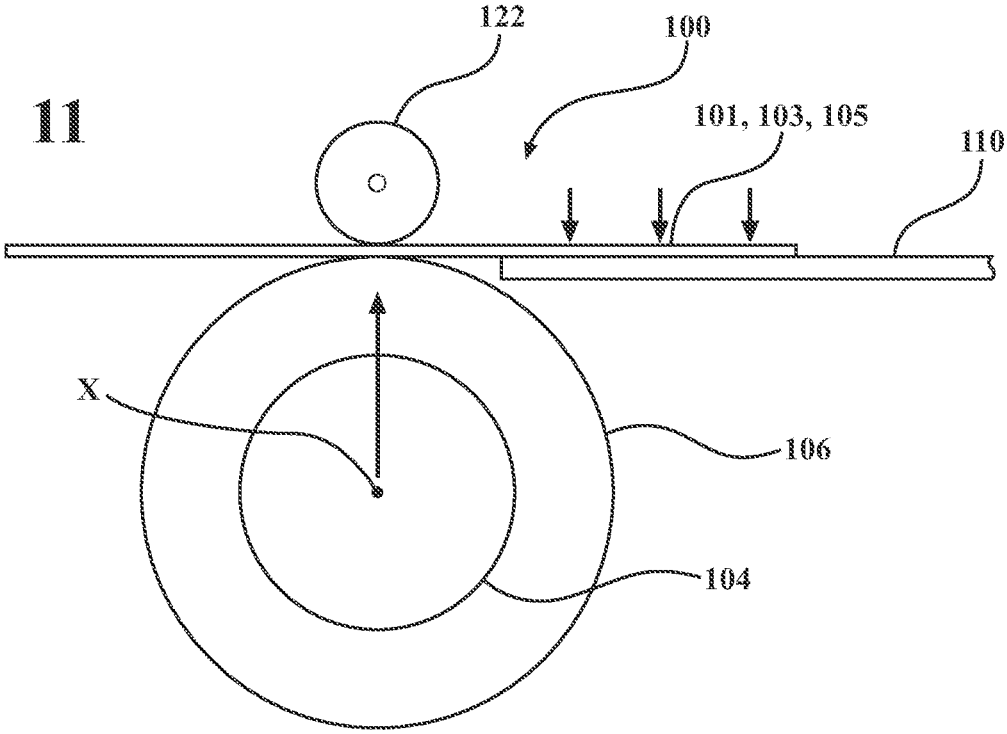
FIG. 11 is an enlarged, side elevational view of the multiple printing plate mounting system shown in FIG. 10, and illustrating a positioning of the roller at a top dead center position of the sleeve and a movement of the sleeve to contact the bottoms of all of the printing plates simultaneously.

Once the alignment has been proofed or verified, the system 100 of the present disclosure is used in the step of simultaneously mounting the plurality of printing plates 101, 103, 105, including the first printing plate 101 and the second printing plate 103, onto the printing sleeve 106. In particular, the step of mounting the plurality of printing plates 101, 103, 105 further includes steps of applying the vacuum suction at the back plate 110 to secure the printing plates 101, 103, 105 to the back plate 110. Then, the filler plate 112 is moved away from between the front plate 108 and the back plate 110, for example, as shown in FIG. 10. The method further includes a step of moving the mandrel 104 upwardly to contact the printing plates 101, 103, 105, for example, as shown in FIG. 11.

Figure 12:
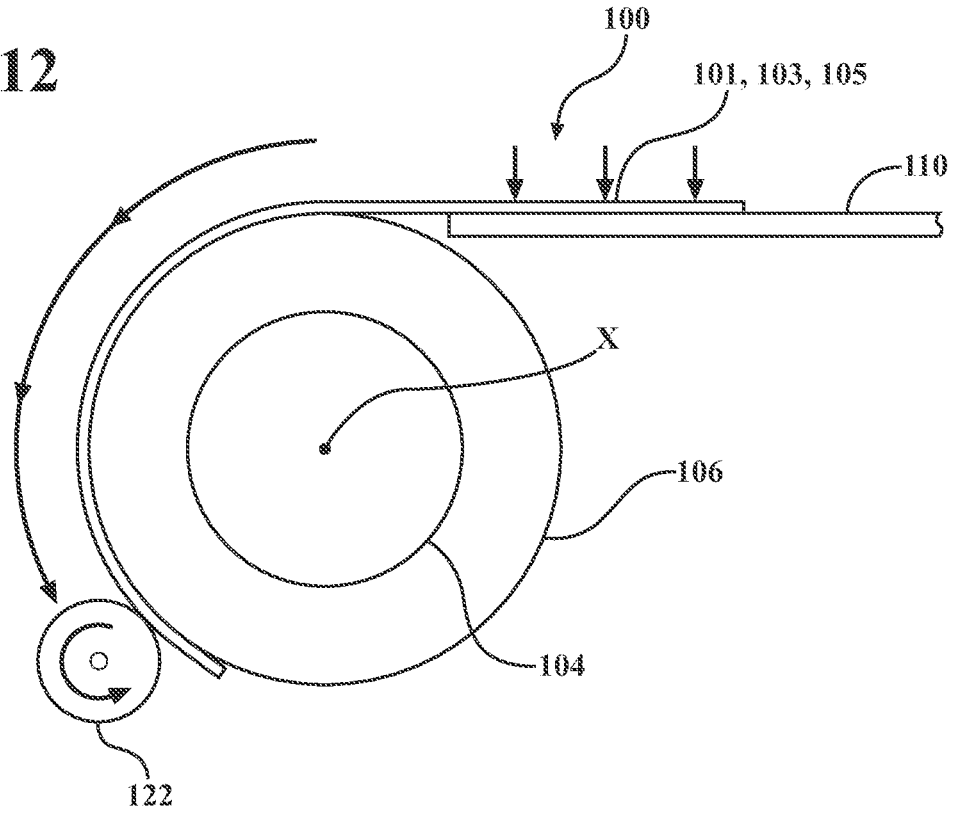
FIG. 12 is an enlarged, side elevational view of the multiple printing plate mounting system shown in FIG. 10, and illustrating an interpolation movement of the roller around the sleeve to apply the printing plates to the sleeve.
Figure 13:
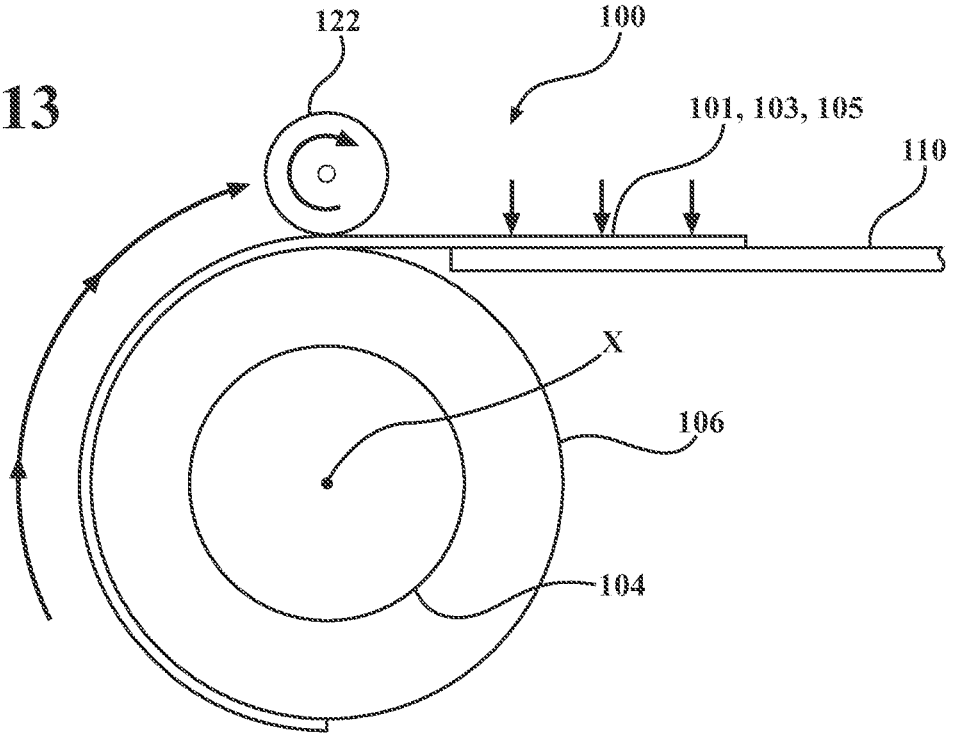
FIG. 13 is an enlarged, side elevational view of the multiple printing plate mounting system shown in FIG. 10, and illustrating a return movement of the roller around the sleeve to the top dead center position.

Then, as shown in FIG. 12, the pressure roller 122 is moved from a top dead center position (shown in FIGS. 10-11 and 13-14) in a first direction around the mandrel 104 to cause a first portion of the printing plates 101, 103, 105 to be pressed onto the printing sleeve 106 of the mandrel 104. The method further includes a step of moving the pressure roller 122 in a second direction around the mandrel 104 to return the pressure roller 122 to the top dead center position, for example, as shown in FIG. 13.

Figure 14:
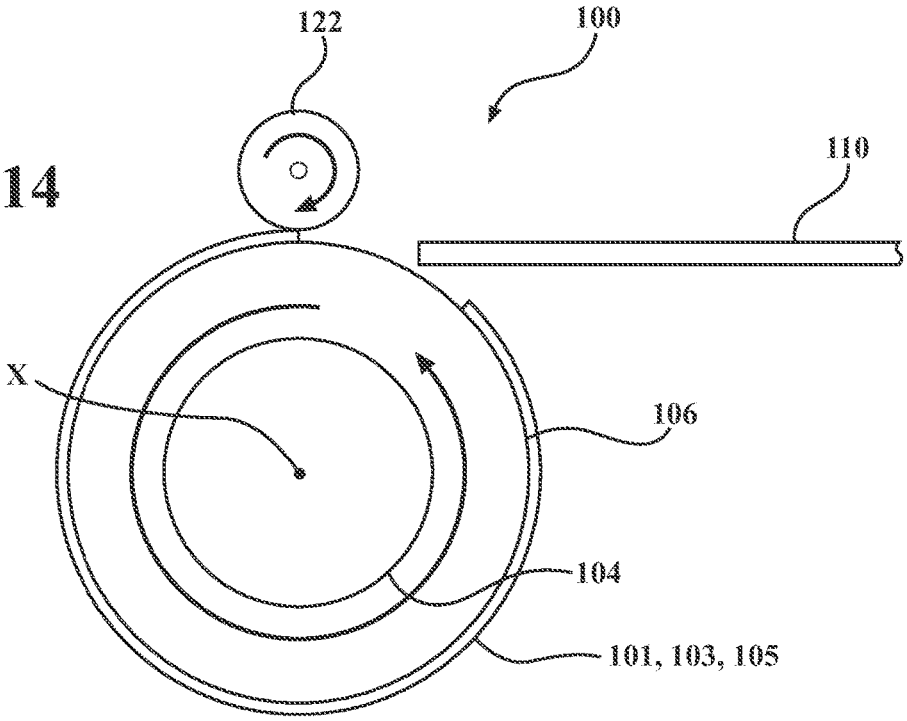
FIG. 14 is an enlarged, side elevational view of the multiple printing plate mounting system shown in FIG. 10, and illustrating a rotational movement of the sleeve to apply a remaining portion of each of the printing plates to the sleeve.
Figure 15:
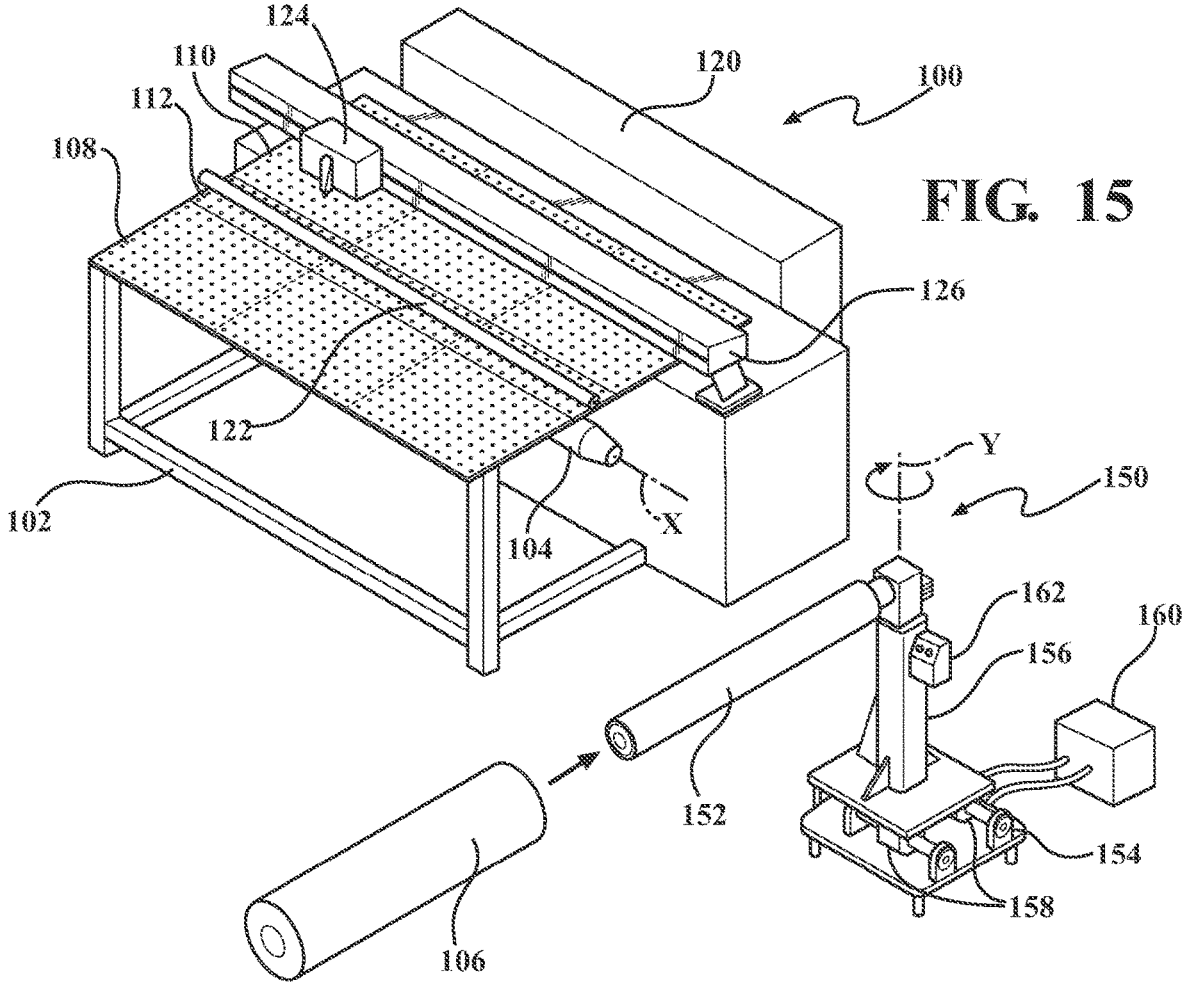
FIG. 15 is a top perspective view of the multiple printing plate mounting system shown in FIG. 1, and illustrating the system prior to the sleeve having been mounted onto the mandrel and a pre-mounting movement of the sleeve onto a sleeve tube of the cylinder transfer assembly.

The vacuum suction is then unapplied or removed at the back plate 110 to release the printing plates 101, 103, 105 from the back plate 110. The method then includes a step of rotating the mandrel 104, and likewise the printing sleeve 106 on the mandrel 104, while the pressure roller 122 is at the top dead center position, as shown in FIG. 14. This rotation causes a second portion of the printing plates 101, 103, 105 to be pressed on the printing sleeve 106 of the mandrel 104, whereby the printing plates 101, 103, 105 are fully mounted to the printing sleeve 106 for use in a subsequent printing operation.

Throughout the method described herein, it should be appreciated that suitable pressures and forces applied with the pressure roller 122 and the vacuum suction may be selected by one of ordinary skill in the art, as desired. Thus, the method is not otherwise limited to any particular pressures or forces for use in simultaneously mounting the plurality of printing plates 101, 103, 105.

As described further hereinabove, the multiple printing plate mounting system 100 may further include the cylinder transfer assembly 150. The cylinder transfer assembly 150 is configured to selectively mount the printing sleeve 106 onto the mandrel 104 of the support 102 prior to the mounting of the printing plates 101, 103, 105 to the printing sleeve 106.

Figure 16:
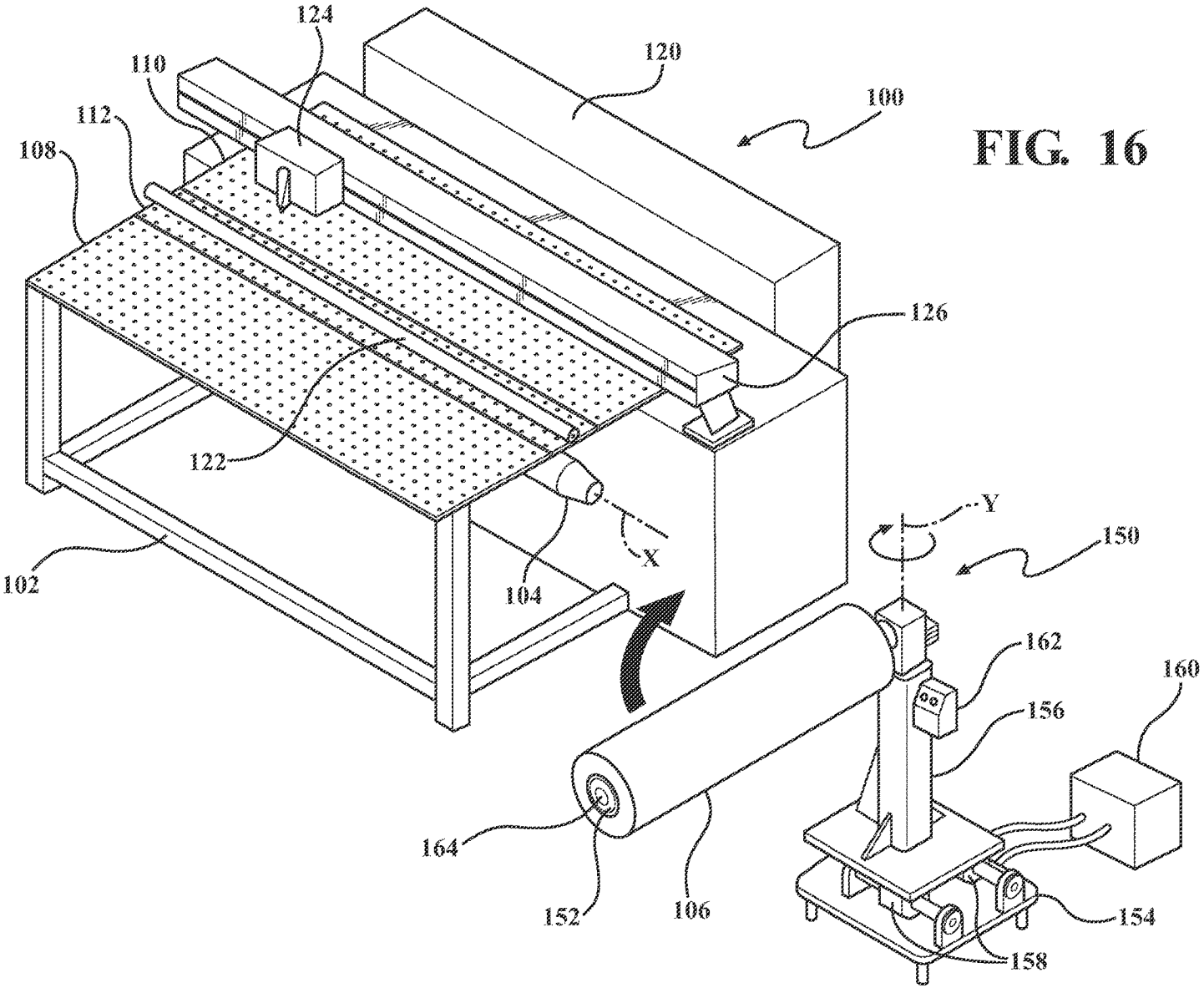
FIG. 16 is a top perspective view of the multiple printing plate mounting system shown in FIG. 15, and illustrating the system with the sleeve pre-mounted onto the cylinder transfer assembly and the sleeve tube of the cylinder transfer assembly being rotated to a mounting position.

In one example, the method of the present disclosure may include a step of providing the sleeve tube 152 of the cylinder transfer assembly 150 in the loading position. In the loading position, shown in FIG. 1, it should be appreciated that the sleeve tube 152 is not in axial alignment with the mandrel 104, or the longitudinal axis X of the mandrel 104 is transverse a longitudinal axis Z (shown in FIG. 1) of the sleeve tube 152. This permits the operator to manually load the printing sleeve 106 onto the sleeve tube 152 of the cylinder transfer assembly 150, for example, as shown in FIG. 16.

Upon the printing sleeve 106 being loaded onto the sleeve tube 152 of the cylinder transfer assembly 150, the sleeve tube 152 is then rotated to the mounting position, for example, either manually by the operator or under actuated movement due to the operation of the controller 162. As shown in FIGS. 17-21, the sleeve tube 152 is in axial alignment with the mandrel 104 of the system 100 (i.e., the axes X and Z are aligned or coaxial) where the sleeve tube 152 is in the mounting position. It should be appreciated that the mounting position of the sleeve tube 152 thereby permits for a moving of the printing sleeve 106 onto the mandrel 104 as described further herein.

Figure 17:
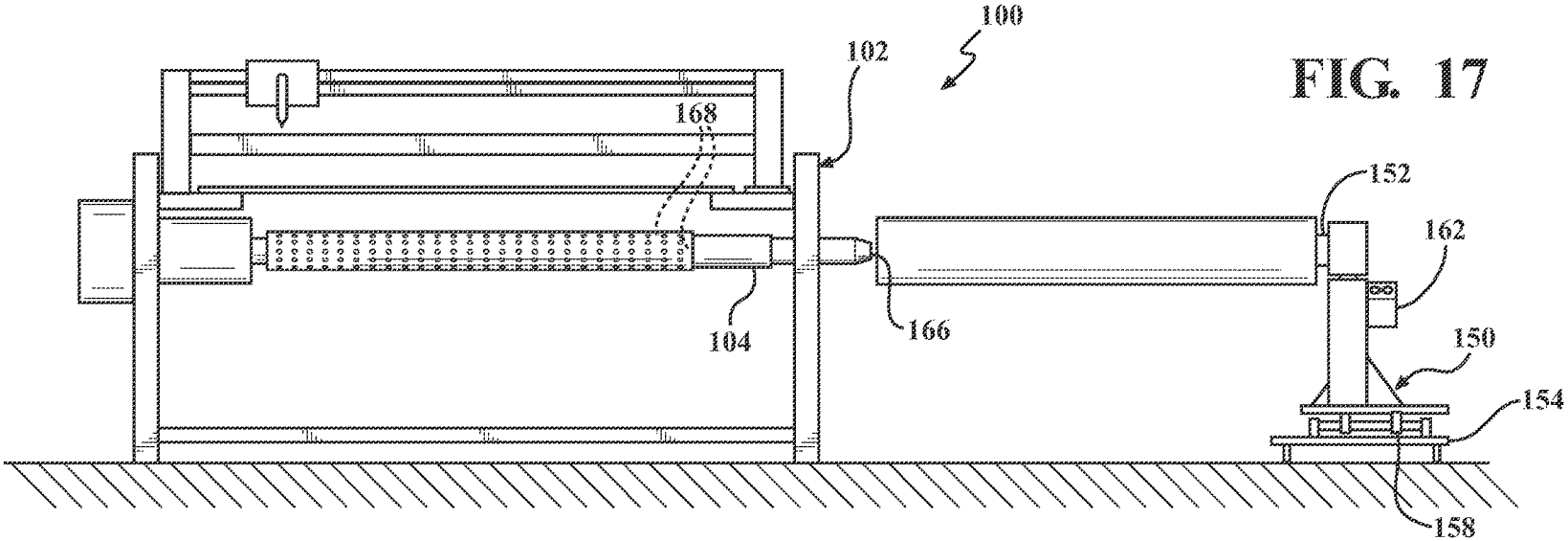
FIG. 17 is a front elevational view of the multiple printing plate mounting system shown in FIG. 15, and illustrating the cylinder transfer assembly in the mounting position adjacent to the mandrel.

Once the sleeve tube 152 with the printing sleeve 106 is in the mounting position, the sleeve tube 152 is moved to engage with the mandrel 104. For example, the movement of the sleeve tube 152 may be caused by moving the tower 156 on the support 154 toward the base 102 of the system 100, as shown in FIGS. 17-18.

Figure 18:
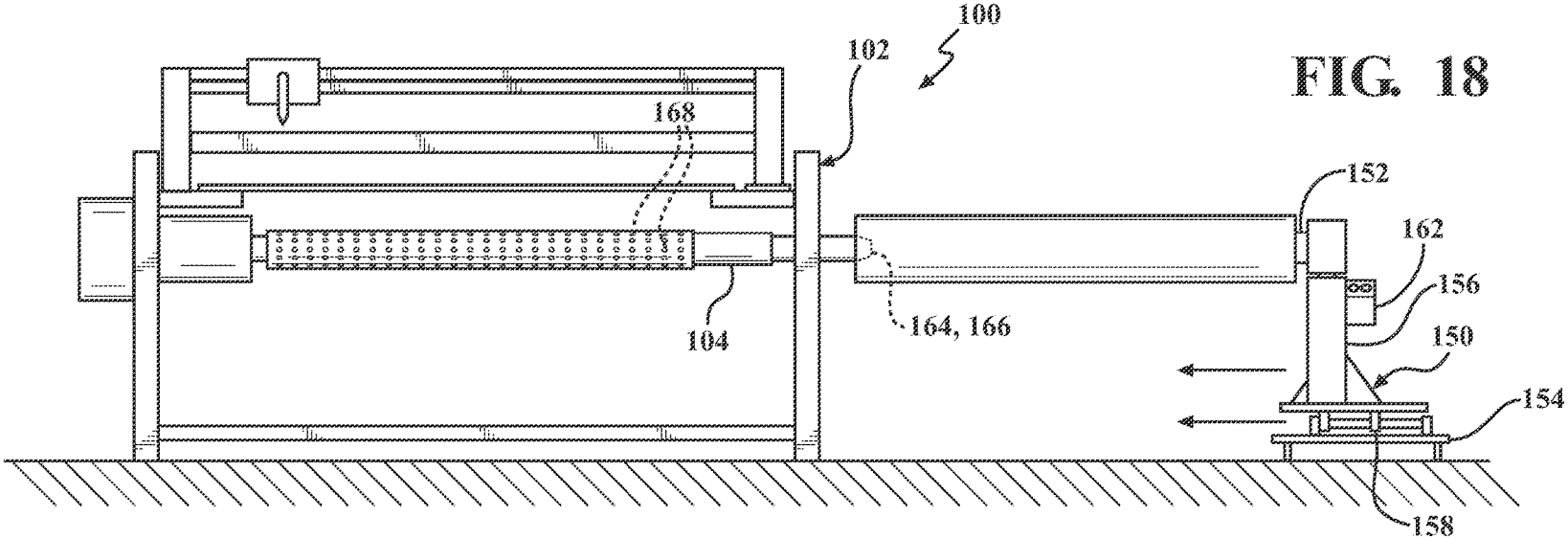
FIG. 18 is a front elevational view of the multiple printing plate mounting system shown in FIG. 15, and illustrating a lateral movement of the cylinder transfer assembly in order to engage the sleeve tube of the cylinder transfer assembly with the mandrel for mounting of the sleeve onto the mandrel.
Figure 19:
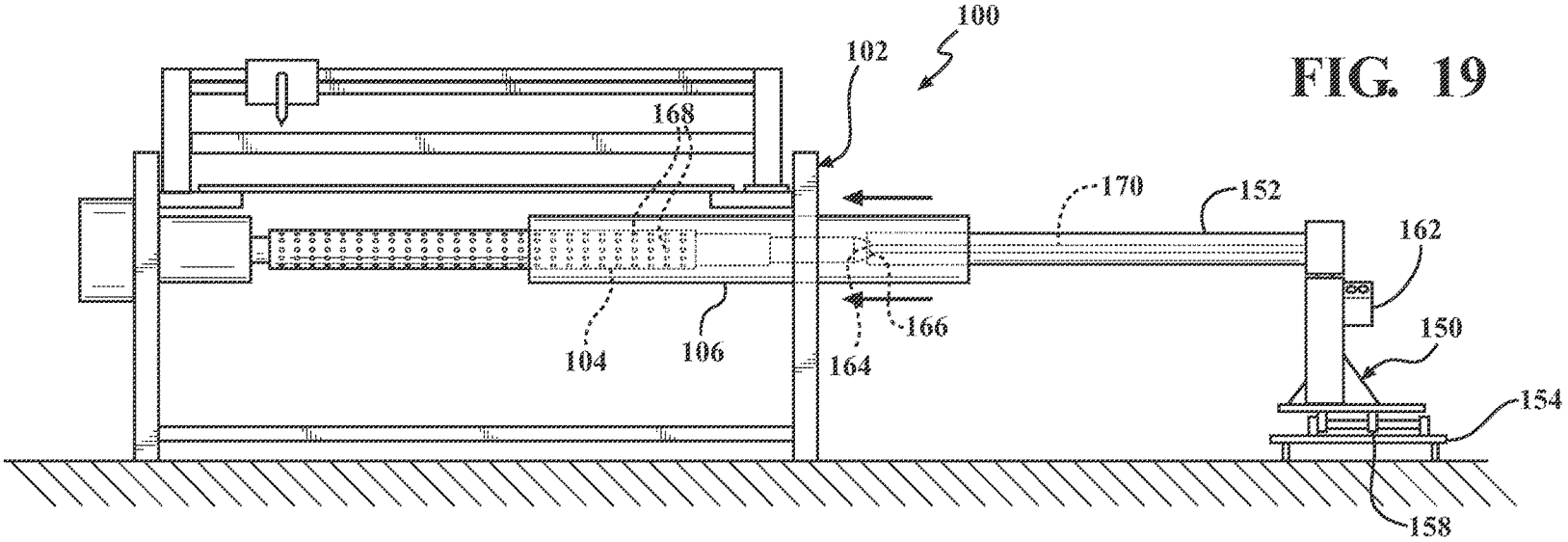
FIG. 19 is a front elevational view of the multiple printing plate mounting system shown in FIG. 15, and illustrating a lateral movement of the sleeve onto the mandrel.
Figure 20:
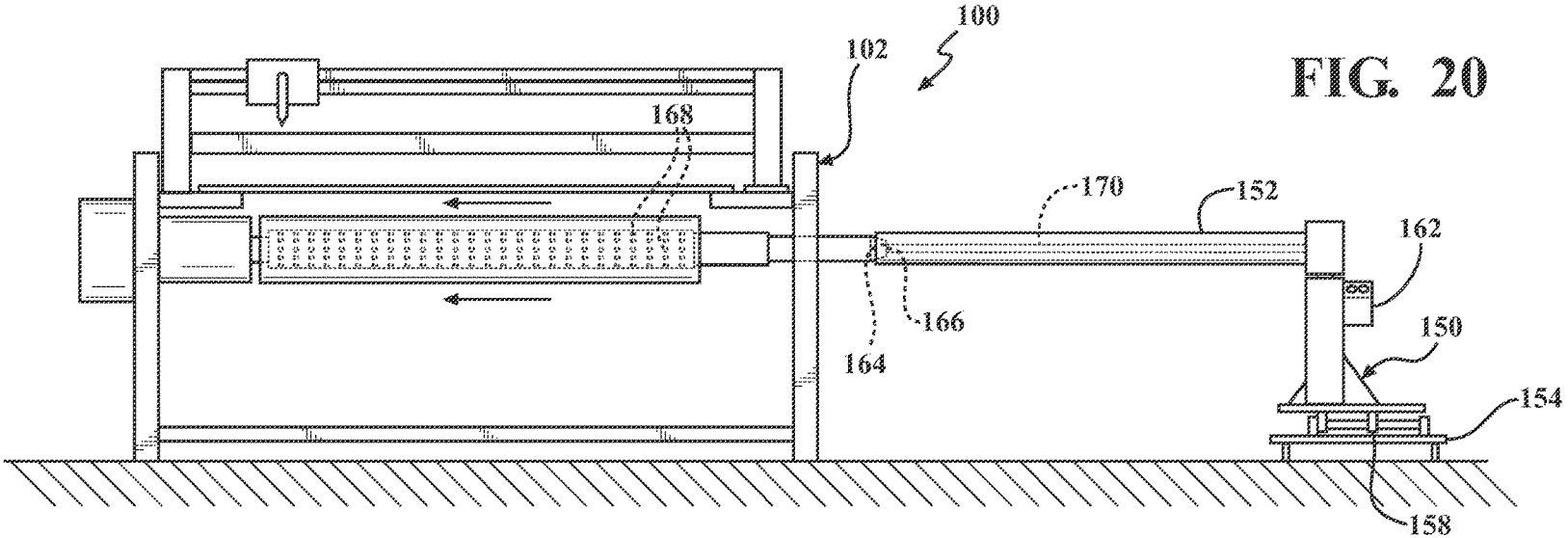
FIG. 20 is a front elevational view of the multiple printing plate mounting system shown in FIG. 15, and illustrating the sleeve in a mounted position on the mandrel.

In particular, the movement and the engaging of the sleeve tube 152 with the mandrel 104 results in a sealing of an end 164 of the sleeve tube 152 with an end 166 of the mandrel 104, as shown in FIGS. 18-20. Each of the mandrel 104 and the sleeve tube 152 is hollow, with the hollow portion of the sleeve tube 152 being an air flow conduit 170 as shown in FIGS. 19-20. The mandrel 104 further has plurality of holes 168, which are placed in fluid communication with the air flow conduit 170 of the sleeve tube 152 upon the sleeve tube 152 being engaged and sealed with the mandrel 104. Although the plurality of holes 168 are shown being spaced evenly apart along a length of the mandrel 104, it should be appreciated that the holes 168 may be any suitable size, shape, number, or configuration as may be chosen by a skilled artisan. The holes 168 permit for a pressurized flow of air to be supplied to the printing sleeve 106 through the mandrel 104 via the sleeve tube 152 of the cylinder transfer assembly 150 in operation. It should also be appreciated that the cylinder transfer assembly 150 may be provided in communication with a pump or other source of pressurized air for this purpose.

In a next step, the method includes a sliding of the printing sleeve 106 from the sleeve tube 152 and onto the mandrel 104 while they are engaged, for example, as shown in FIGS. 19-20. In this step, the pressurized air flow is provided to the which likewise facilitates a manual movement of the printing sleeve 106 onto the mandrel 104. Without being bound to any particular theory, it is believed that the pressurized flow of air may slightly expand the printing sleeve 106 in this step, which is otherwise firmly held by friction force on the mandrel 104, and creates an air cushion that allows the operator to manually move the printing sleeve 106 while the pressurized flow of air is being supplied.

Figure 21:
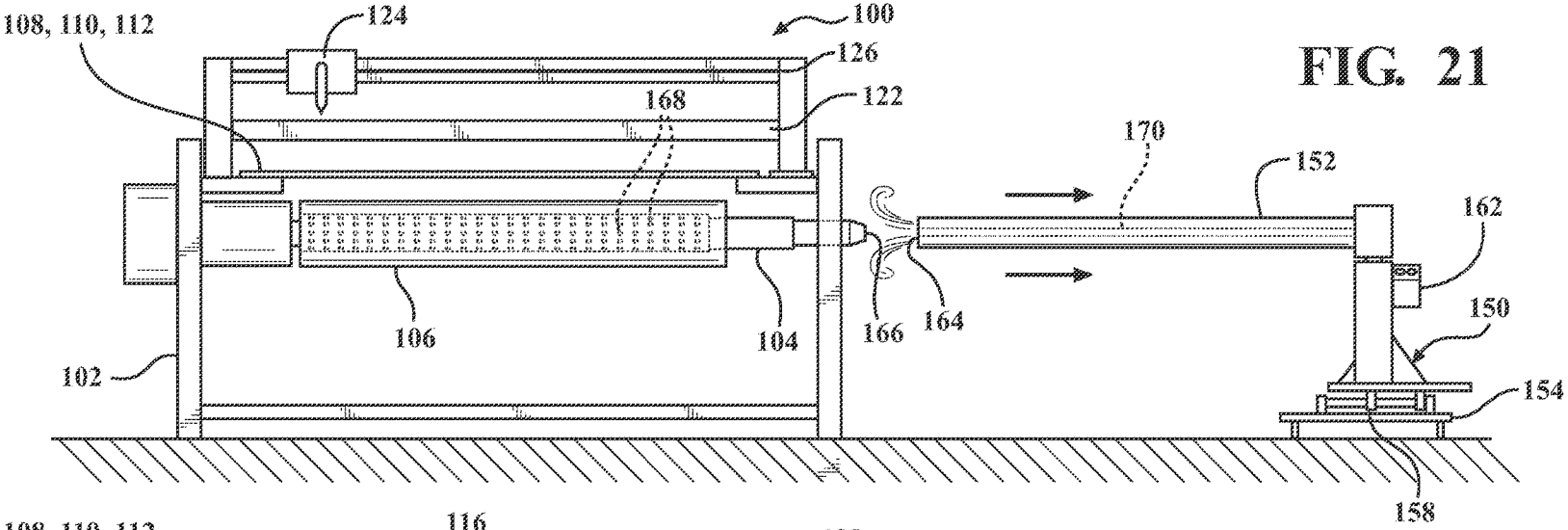
FIG. 21 is a front elevational view of the multiple printing plate mounting system shown in FIG. 15, and illustrating a lateral movement of the cylinder transfer assembly in order disengage the sleeve tube of the cylinder transfer assembly from the mandrel following the mounting of the sleeve onto the mandrel.

Once the printing sleeve 106 has been moved onto the mandrel 104 into the desired or predetermined position reading for plate mounting, the sleeve tube 152 is then disengaged from the mandrel 104. For example, the step of disengaging the sleeve tube 152 may be caused by moving the tower 156 on the support 154 in a direction away from the base 102 of the system, as shown in FIG. 21. It should be appreciated that the disengagement may cease the flow of pressurized air to the mandrel 104, which causes the printing sleeve 106 to be firmed seated by friction force with the same. The printing sleeve 106 is thereby provided ready for the plate mounting operation as described herein.

Although the multiple printing plate mounting system 100 and associated method is described herein primarily with respect to sequential alignment and simultaneous mounting of three (3) flexible printing plates 101, 103, 105, it should be appreciated that the system 100 and method is not limited to just three (3) printing plates 101, 103, 105. In a most particular embodiment, up to six (6) plates are simultaneously mounted as described. One of ordinary skill in the art may also select other suitable numbers of the printing plates 101, 103, 105 for use with the present technology, as desired.

While certain representative embodiments and details have been shown for purposes of illustrating the invention, it will be apparent to those skilled in the art that various changes may be made without departing from the scope of the disclosure, which is further described in the following appended claims.

What is claimed is:

1. A method for mounting multiple printing plates, the method comprising the steps of:

providing multiple printing plate mounting system including a base having a mandrel for supporting a printing sleeve configured to receive a plurality of flexible printing plates thereon, the mandrel having a central axis, a front table movably coupled to the base and having a plurality of vacuum zones, a back table movably coupled to the base and having a plurality of vacuum zones, a filler table movably coupled to the base and having a plurality of vacuum zones, the filler table selectively disposed between the front table and the back table in order to provide support to the plurality flexible printing plates during the alignment thereof, and a control system in communication with the front table, the back table, and the filler table, the control system configured to cause a movement of at least one of the front table, the back table, and the filler table for selective, individual, and independent alignment of each of the plurality of flexible printing plates relative to the central axis of the mandrel, wherein the plurality of flexible printing plates includes a first printing plate and a second printing plate, and the plurality of vacuum zones includes a first vacuum zone and a second vacuum zone;

mounting the printing sleeve on the mandrel;

disposing the first printing plate in the first vacuum zone, and the second printing plate in the second vacuum zone, across all of the front table, the filler table, and the back table;

applying, by the control system, vacuum suction in the first vacuum zone;

moving at least one of the front table, the filler table, and the back table with the vacuum suction applied in the first vacuum zone to align the first printing plate;

unapplying, by the control system, the vacuum suction in the first vacuum zone;

applying, by the control system, the vacuum suction in the second vacuum zone;

moving at least one of the front table, the filler table, and the back table with the vacuum suction applied in the second vacuum zone to align the second printing plate; and mounting the plurality of printing plates including the first printing plate and the second printing plate simultaneously, upon being aligned, onto the printing sleeve.

2. The method of claim 1, wherein each of the flexible printing plates has a plurality of registration marks, the plurality of registration marks including a first registration mark and a second registration mark, and the multiple printing plate mounting system further includes a laser pointer movably coupled to the base, and the method further includes steps of:

providing the laser pointer at a position adjacent to a first side of the first printing plate;

projecting the laser light, by the laser pointer, toward the first printing plate and manually orienting the first printing plate so that the first registration mark of the first printing plate coincides with the laser light; and moving the laser pointer to a position adjacent to a second side of the first printing plate; and projecting the laser light, by the laser pointer, toward the first printing plate and manually orienting the first printing plate so that the second registration mark of the first printing plate coincides with the laser light.

3. The method of claim 2, wherein the method further includes step of proofing the position of each of the first plate and the second plate with the laser pointer following the first printing plate and the second printing plate being aligned and prior to the step of mounting the first printing plate and the second printing plate simultaneously.

4. The method of claim 1, wherein the multiple printing plate mounting system further includes a pressure roller movably coupled to the base and configured to selectively interpolate about the printing sleeve to simultaneously secure all of the plurality of flexible printing plates to the printing sleeve, and the method further includes the step of mounting the plurality of printing plates further includes steps of:

applying the vacuum suction at the back plate to secure the printing plates to the back plate;

moving the filler plate away from between the front plate and the back plate;

moving the mandrel upwardly to contact the printing plates;

moving the pressure roller from a top dead center position in a first direction around the mandrel to cause a first portion of the printing plates to be pressed onto the printing sleeve of the mandrel;

moving the pressure roller in a second direction around the mandrel to return the pressure roller to the top dead center position;

unapplying the vacuum suction at the back plate to release the printing plates from the back plate; and rotating the mandrel to cause a second portion of the printing plates to be pressed on the printing sleeve of the mandrel, whereby the printing plates are mounted to the printing sleeve.

5. The method of claim 1, wherein the multiple printing plate mounting system further includes a cylinder transfer assembly disposed adjacent to the base, the cylinder transfer assembly including a support, a tower, and a sleeve tube, the tower disposed on the support and laterally movable relative to the support, and the sleeve tube disposed on the tower and rotatably movable about a longitudinal axis of the tower between a loading position and a mounting position, wherein the cylinder transfer assembly is configured to selectively mount the printing sleeve onto the mandrel of the support.

6. The method of claim 5, wherein the step of mounting printing sleeve on the mandrel includes steps of:

providing the sleeve tube of the cylinder transfer assembly in the loading position, the sleeve tube not being in axial alignment with the mandrel in the loading position;

loading the printing sleeve onto the sleeve tube of the cylinder transfer assembly;

rotating the sleeve tube of the cylinder transfer assembly to the mounting position, the sleeve tube being in axial alignment with the mandrel in the mounting position;

engaging the sleeve tube with the mandrel by moving the tower on the support toward the base;

sliding the printing sleeve from the sleeve tube onto the mandrel; and disengaging the sleeve tube from the mandrel by moving the tower on the support away from the base.

7. The method of claim 6, further comprising a step of supplying a pressurized airflow to the mandrel where the sleeve tube is engaged with the mandrel in order to provide a cushion of air between the printing sleeve and the mandrel to facilitate the sliding of the printing sleeve from the sleeve tube onto the mandrel.

* * * * *